US010843488B2

(12) United States Patent
Kobashi et al.

(10) Patent No.: US 10,843,488 B2
(45) Date of Patent: Nov. 24, 2020

(54) LIQUID DISCHARGING DEVICE

(71) Applicants: Toshiyuki Kobashi, Kanagawa (JP); Satoyuki Sekiguchi, Kanagawa (JP); Taku Hatakeyama, Kanagawa (JP); Takashi Watanabe, Kanagawa (JP)

(72) Inventors: Toshiyuki Kobashi, Kanagawa (JP); Satoyuki Sekiguchi, Kanagawa (JP); Taku Hatakeyama, Kanagawa (JP); Takashi Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/580,293

(22) Filed: Sep. 24, 2019

(65) Prior Publication Data

US 2020/0101767 A1 Apr. 2, 2020

(30) Foreign Application Priority Data

Sep. 27, 2018 (JP) ..... 2018-182407

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 3/4078; B41J 3/543; B41J 2/2114; B41J 11/0015; B41J 11/00
See application file for complete search history.

(56) References Cited

U.S. PATENT DOCUMENTS

2004/0212667 A1* 10/2004 Nishiguchi ..... C09D 11/54 347/96
2009/0244138 A1* 10/2009 Konno ..... B41J 29/393 347/12
2017/0291440 A1* 10/2017 Yamanobe ..... B41J 11/057

FOREIGN PATENT DOCUMENTS

JP 2015-131419 7/2015

OTHER PUBLICATIONS

U.S. Appl. No. 16/355,754, filed Mar. 17, 2019, Satoyuki Sekiguchi, et al.
U.S. Appl. No. 16/355,760, filed Mar. 17, 2019, Toshiyuki Kobashi, et al.

* cited by examiner

*Primary Examiner* — Kristal Feggins
(74) *Attorney, Agent, or Firm* — Oblon, McClelland, Maier & Neustadt, L.L.P.

(57) ABSTRACT

A liquid discharging device includes a first head including a first nozzle formed on a first surface of the first head, the first head being configured to discharge a first ink containing a metal oxide from the first nozzle, a second head including a second nozzle formed on a second surface of the second head, the second head being configured to discharge a second ink containing a coloring material from the second nozzle, a recording medium holding unit configured to hold a recording medium, and a heating device configured to heat the recording medium, wherein the first head discharges the first ink in a state where a first distance between the first surface and the recording medium holding unit is 4.0 mm or more.

11 Claims, 16 Drawing Sheets

LIQUID DISCHARGING DEVICE

CROSS-REFERENCE TO RELATED APPLICATIONS

This patent application is based on and claims priority pursuant to 35 U.S.C. § 119 to Japanese Patent Application No. 2018-182407, filed on Sep. 27, 2018 in the Japan Patent Office, the entire disclosure of which is hereby incorporated by reference herein.

BACKGROUND

Technical Field

The present invention relates to a liquid discharging device.

Description of the Related Art

Since inkjet printers are relatively quiet, enjoy low running costs, and are capable of easily printing color images, they are now widely used at home as an output device of digital signals.

In addition to such a home use, for poorly permeable media such as coated paper, impermeable media such as plastic film, and fabrics such as woven fabrics and knitted fabrics, quality of an image obtained by an inkjet recording method is required to be on a par with that of a typical analog printed image.

For example, in the soft packaging field, high-mix low volume production of print jobs are rapidly progressing and demand for variable printing is increasing. Therefore, development of an inkjet recording system for soft packaging film such as polyolefin-based, polyester-based, and polyamide-based film are expected.

Moreover, the market of so-called Direct to Garment (DTG) of direct printing on fabrics such as T-shirts is increasing every year.

SUMMARY

According to embodiments of the present disclosure, provided is a liquid discharging device which includes a first head including a first nozzle formed on a first surface of the first head, the first head being configured to discharge a first ink containing a metal oxide from the first nozzle, a second head including a second nozzle formed on a second surface of the second head, the second head being configured to discharge a second ink containing a coloring material from the second nozzle, a recording medium holding unit configured to hold a recording medium, and a heating device configured to heat the recording medium, wherein the first head discharges the first ink in a state where a first distance between the first surface and the recording medium holding unit is 4.0 mm or more.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

Figure 1:
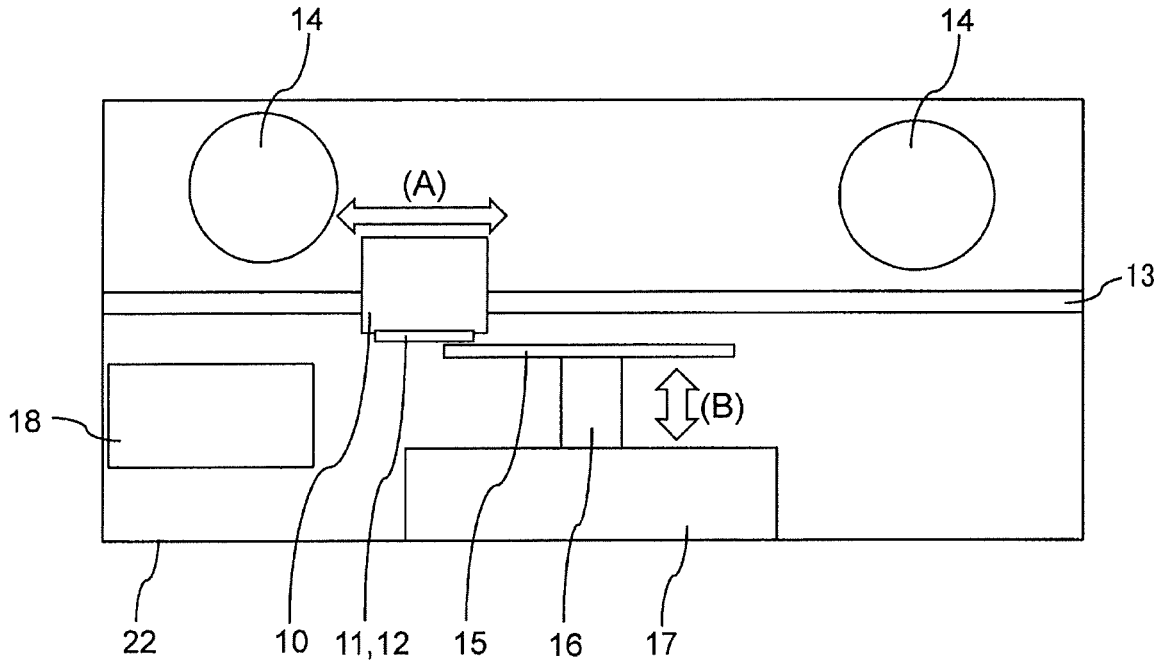
FIG. 1 is a schematic diagram illustrating a liquid discharging device in a perpendicular direction to the conveyance direction of a recording medium according to a first embodiment of the present disclosure.

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF THE EMBODIMENTS

In describing embodiments illustrated in the drawings, specific terminology is employed for the sake of clarity.

However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Moreover, image forming, recording, printing, modeling, etc., in the present disclosure represent the same meaning, unless otherwise specified.

Embodiments of the present invention are described in detail below with reference to accompanying drawing(s). In describing embodiments illustrated in the drawing(s), specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

Demand for both conventional cotton and cotton/polyester blended media and sportswear is also rapidly increasing, which requires polyester media compatibility. This trend applies not only to the DTG field but also to the entire printing field. For inkjet printers including an unwinding and winding mechanism, the demand for an inkjet recording system capable of forming images having excellent coloring and robustness on variety of fabrics including cotton and polyester is increasing more and more.

However, when a pre-processing fluid is applied to plastic film or fabric media, white ink is thereafter printed by an inkjet method, and thereafter color ink is printed, the color ink blurs, which causes disturbance at borders or obscures fine lines.

As a solution to such problems, for example, a method of placing a heating device in the region in which a recording medium is conveyed has been disclosed.

However, since white ink generally tends to precipitate, ink components (metal oxide, etc.) tend to gather near a nozzle. Upon application of heat around the nozzle in this state, the nozzle easily clogs when the ink solvent (moisture, etc.) evaporates. Further, the ink components gathering near the nozzles may be degraded due to the influence of heat. Therefore, if the heating device mentioned above is used, the nozzle of a head tends to clog, thereby degrading discharging reliability. This is particularly true for white ink.

According to the present disclosure, images with good discharging reliability and less bleeding can be provided for coated paper, plastic film, and film when white ink is used.

Hereinafter, the liquid discharging device of the present disclosure is described with reference to the accompanying drawings. It is to be noted that the following embodiments are not limiting the present disclosure and any deletion, addition, modification, change, etc. can be made within a scope in which man in the art can conceive including other embodiments, and any of which is included within the scope of the present disclosure as long as the effect and feature of the present disclosure are demonstrated.

The liquid discharging device of the present disclosure includes a first head including a first surface including a nozzle (first nozzle) formed on the first surface, the first head being configured to discharge a first ink containing a metal oxide from the first nozzle, a second head including a second surface including a nozzle (second nozzle) formed on the second surface, the second head being configured to discharge a second ink containing a coloring material from the second nozzle, a recording medium holding unit configured to hold a recording medium, and a heating device configured to heat the recording medium, wherein the first head discharges the first ink in a state where a first distance between the first surface and the recording medium holding unit is 4.0 mm or more.

Notably, the first ink may be referred to as white ink and the second ink may be referred to as color ink. When the first ink and the second ink are described without distinction, they may be simply referred to as ink.

According to the present disclosure, images with good discharging reliability and less bleeding can be provided for coated paper, plastic film, and film when white ink is used.

An embodiment of the liquid discharging device of the present disclosure is described below. The liquid discharging device of the present embodiment is illustrated in FIG. 1. In FIG. 1, the recording medium is conveyed in the depth direction (or the front direction) of the paper surface. FIG. 1 is a schematic diagram illustrating a cross section of the liquid discharging device in a direction perpendicular to the conveyance direction of the recording medium.

In FIG. 1, a liquid discharging device 22 includes a carriage 10, a first head 11, a second head 12, a carriage scanning rail 13, an exhaust unit 14, a platen 15 (recording medium holding unit), a support member 16, a platen carriage (carriage of recording medium holding unit) 17, and a maintenance unit 18.

The platen 15 holds a recording medium and the size can be changeable.

The recording medium is not particularly limited. Specific examples include, but are not limited to, coated paper, plastic film, and fabric. Also, cloth such as T-shirts and paper can be used.

The platen 15 is supported by the support member 16

The platen carriage 17 moves the platen 15. It moves the platen 15 in the vertical direction (along the direction indicated by the arrow B) and in the conveyance direction of the recording medium.

The maintenance unit 18 maintains the heads 11 and 12 and includes a cap, a suction pump, a dummy discharge receiver, etc.

The carriage 10 is a housing including the first head 11 and the second head 12. It also includes an encoder sensor, a moving belt, an elevating mechanism, etc.

The carriage scanning rail 13 is to move the carriage 10 in the direction perpendicular to the conveyance direction of the recording medium.

Note that the direction perpendicular to the conveyance direction of the recording medium may be referred to as the main scanning direction, which is indicated by the arrow A in FIG. 1. In addition, the conveyance direction of the recording medium may be referred to as the sub-scanning direction. The main scanning direction and the sub-scanning direction are orthogonal to each other.

The first head 11 discharges the first ink and the second head 12 discharges the second ink. The first head 11 is disposed upstream of the second head 12 in the conveyance direction of the recording medium. When the first head 11 and the second head 12 are described without a distinction, they may be simply referred to as heads.

The exhaust unit 14 exhausts the air in the liquid discharging device 22 outside. For example, it may include a fan or a motor-driven fan.

Figure 2:
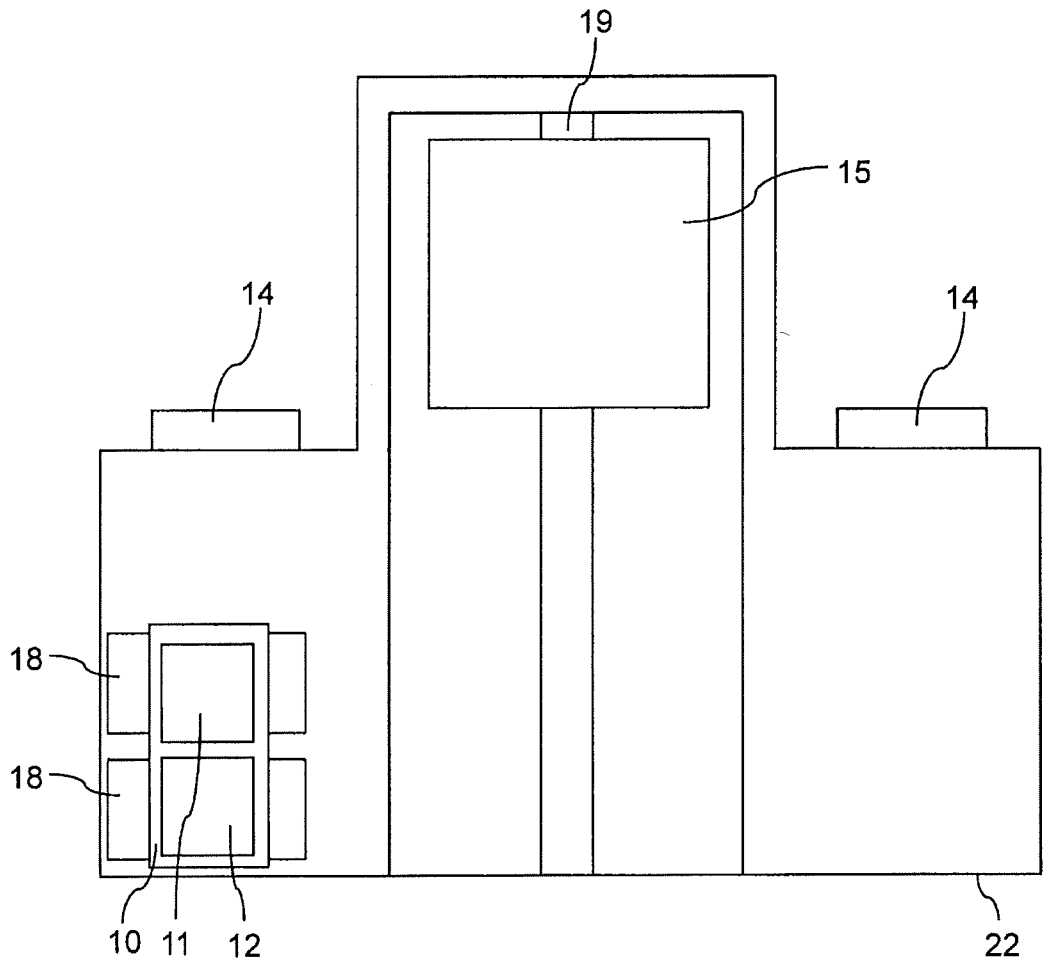
FIG. 2 is a diagram illustrating a planar view of an example of a liquid discharging device according to a first embodiment of the present disclosure.

FIG. 2 is a schematic diagram illustrating a planar view of the liquid discharging device of the present embodiment. The carriage 10 and the platen 15 are in the state of standing before moving.

As illustrated in FIG. 2, the carriage 10 includes the first head 11 and the second recording head 12. In FIG. 2, the carriage scanning rail 13 is omitted.

The platen 15 moves along the platen moving rail 19.

Figure 3:
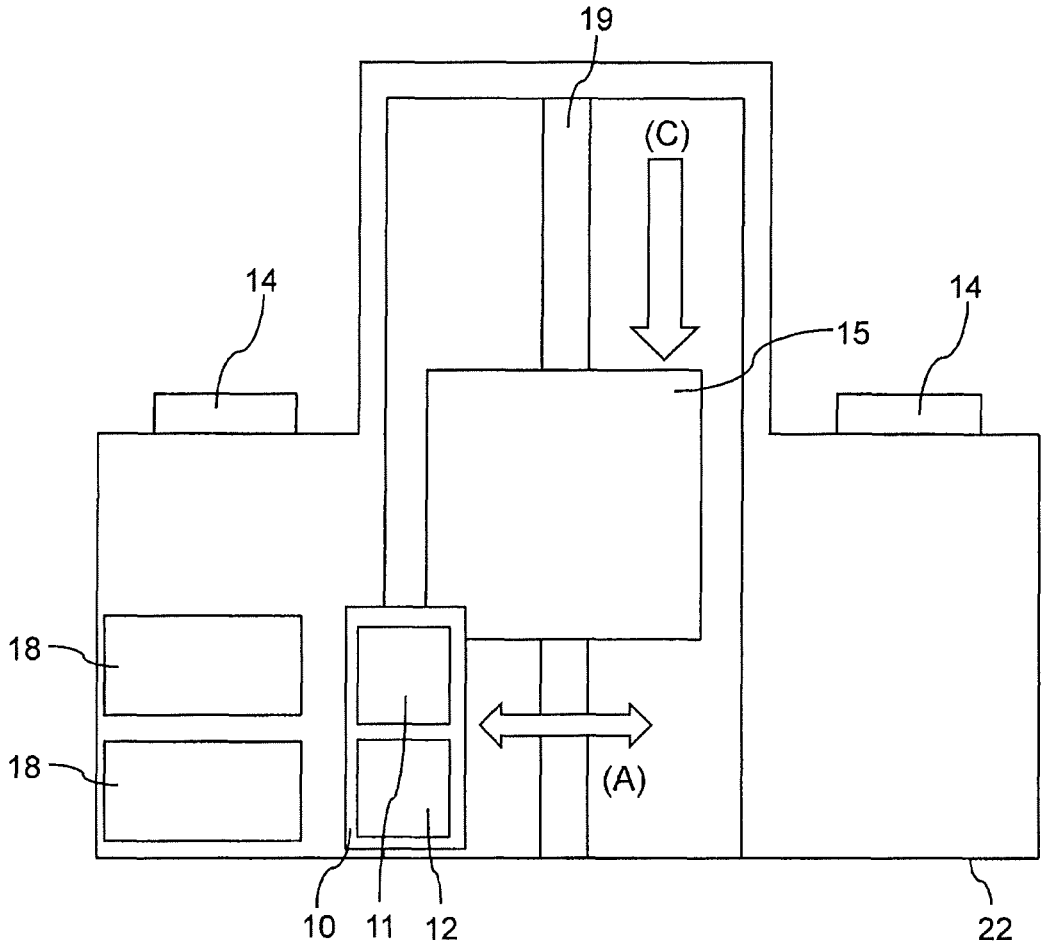
FIG. 3 is a diagram illustrating a planar view of another example of a liquid discharging device according to a first embodiment of the present disclosure.

FIG. 3 is a schematic diagram illustrating another planar view of the liquid discharging device of the present embodiment. In this state, the carriage 10 and the platen illustrated in FIG. 2 are moved.

As illustrated in FIG. 3, the platen 15 moves along the platen moving rail 19 in the direction indicated by the arrow C in FIG. 3. Since the recording medium moves while being held on the platen 15, the moving direction of the platen 15 coincides with the conveyance direction of the recording medium.

As illustrated in FIG. 3, the second head 12 is disposed downstream of the first head 11 in the conveyance direction of the recording medium.

The platen 15 moves in the direction indicated by the arrow C and the liquid is discharged from the heads 11 and 12 near the carriage 10 while the carriage 10 scans in the main scanning direction (direction A in FIG. 3). At this point, the first head 11 discharges the first ink toward the recording medium first and thereafter the second head 12 discharges the second ink toward the recording medium.

Figure 4:
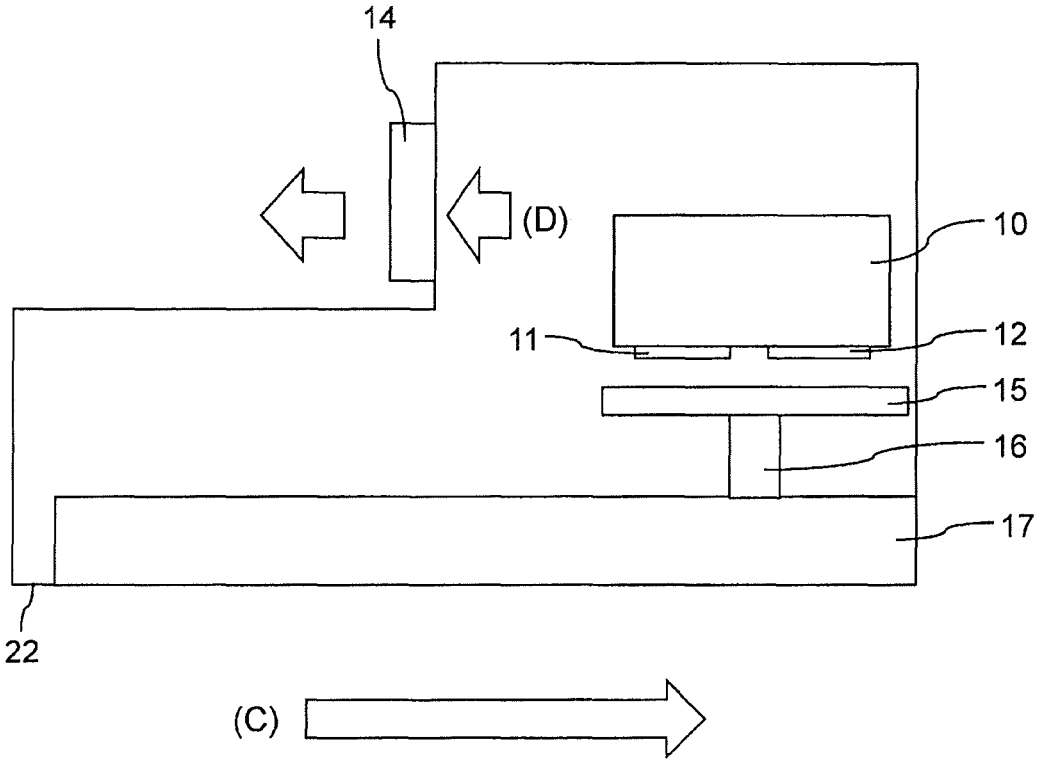
FIG. 4 is a diagram illustrating a side view of an example of a liquid discharging device according to a first embodiment of the present disclosure.
Figure 5:
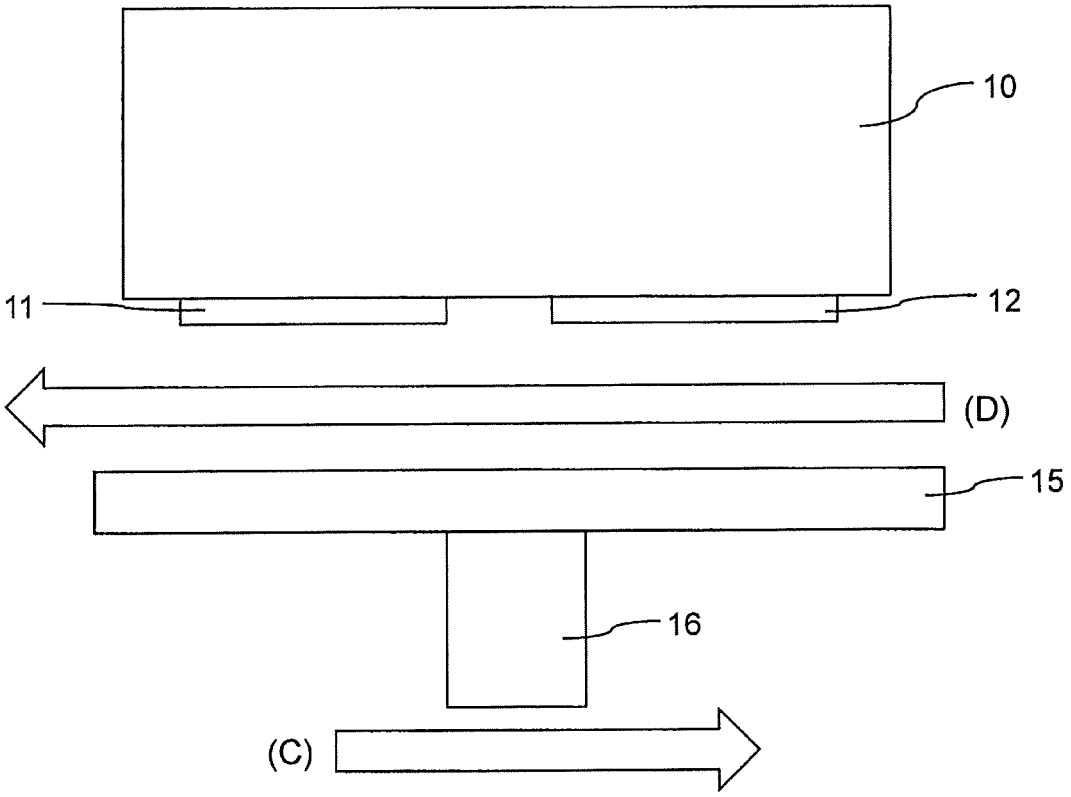
FIG. 5 is a diagram illustrating a side view of another example of a liquid discharging device according to a first embodiment of the present disclosure.

FIG. 4 is a schematic diagram illustrating a side view of the liquid discharging device of the present embodiment. FIG. 5 is a diagram illustrating an enlarged view of a part of the liquid discharging device illustrated in FIG. 4.

The exhaust unit 14 of the present embodiment is preferably disposed in such a manner that the gas between the first head 11 and the platen 15 (or the recording medium) flows upstream in the conveyance direction of the recording medium. Further, the gas inside the liquid discharging device 22 is exhausted to the outside as indicated by the arrow D in FIG. 4.

As a result, as illustrated in FIG. 5, the gas in the space between the platen 15 and each head 12 is directed from the second head 12 to the first head 11 (the direction indicated by the arrow D in FIG. 5). In other words, the gas between the first head 11 and the platen (or the recording medium) flows upstream in the conveyance direction of the recording medium.

For this reason, the mist of the first ink produced around the first head 11 does not easily reach the second head 12, which makes it possible to prevent the mist of the first ink from adhering to the nozzle forming surface of the second head 12, thereby preventing the second ink from agglomerating. Further, due to the prevention of agglomeration of the second ink, discharging reliability ameliorates.

As illustrated in FIG. 5, the gas flow in the space between the second head 12 and the platen 15 (or the recording medium) may also flow upstream in the conveyance direction of the recording medium.

Figure 6:
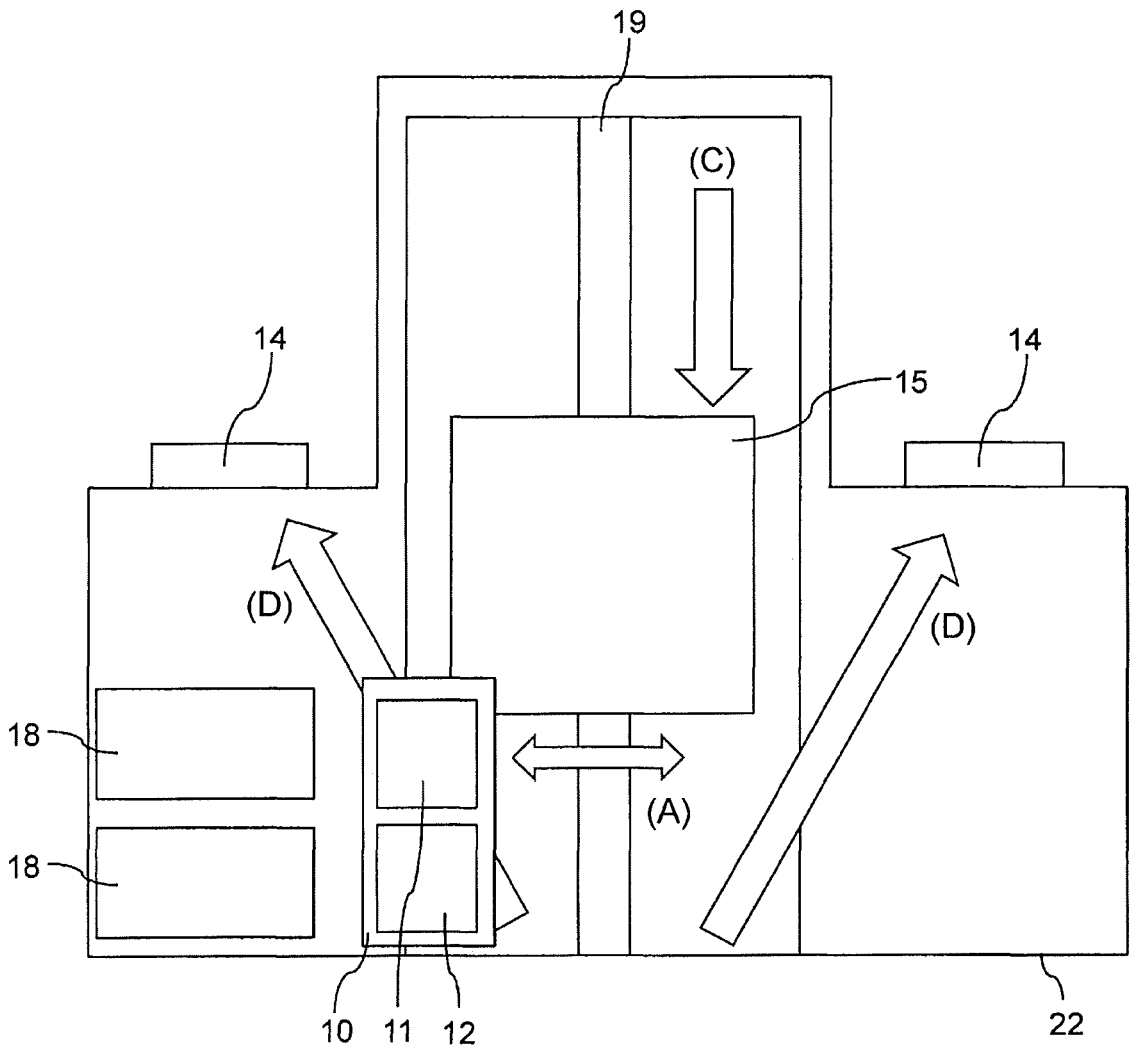
FIG. 6 is a diagram illustrating a planar view of another example of a liquid discharging device according to a first embodiment of the present disclosure.

FIG. 6 is a schematic diagram illustrating another planar view of the present embodiment. In FIG. 6, the air flow indicated by the arrow D is added to the planar view illustrated in FIG. 3.

As illustrated in FIG. 6, in the liquid discharging device of the present embodiment, a plurality of exhaust units 14 are disposed. In the present embodiment, the plurality of exhaust units 14 are all disposed upstream of the first head 11 in the conveyance direction (indicated by the arrow C) of the recording medium.

As a result, the exhausted gas is directed upstream of the conveyance direction of the recording medium, thereby demonstrating the above-described effects.

Note that the position of the recording medium may be fixed and the carriage may be conveyed upstream and downstream. In this case, "upstream and downstream in the conveyance direction of the recording medium" in the present embodiment may be considered as the conveyance direction relative to the head. That is, the upstream of the conveyance direction of the recording medium corresponds to the downstream in the conveyance direction of the head, and the downstream in the conveyance direction of the recording medium corresponds to the upstream in the conveyance direction of the head.

Figure 7:
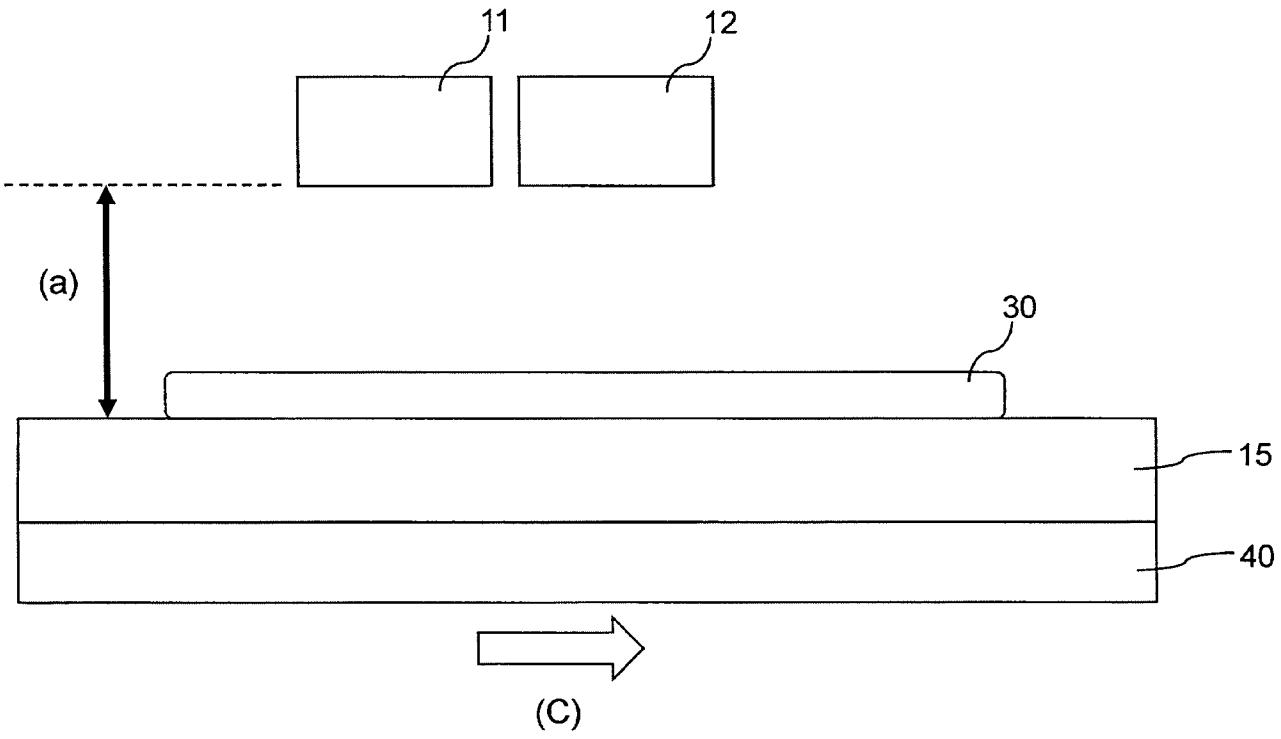
FIG. 7 is a schematic diagram illustrating a part of the liquid discharging device according to a first embodiment of the present disclosure.

Next, FIG. 7 is a schematic diagram illustrating a part of the liquid discharging device in the present embodiment. In FIG. 7, the liquid discharging device 22 includes the first head 11 that discharges the first ink from the first nozzles, the second head 12 that discharges the second ink from the second nozzles, the platen 15 (recording medium holding unit) that holds a recording medium 30, and a heating device 40 that heats the recording medium 30.

When ink is applied to a recording medium, coloring can be enhanced by using the white ink (first ink) as a backdrop. Therefore, white ink is normally used as a backdrop when printing on film or fabric.

However, when the backdrop of white ink is not dried (heated), bleeding occurs at the color boundary between the color ink (second ink) and the white ink, in particular on media such as fabric and film. A solution to prevent this bleeding may be that white ink is applied and thereafter dried. However, in general, while inorganic oxides (silica, titanium oxide, etc.) normally used for white ink have higher whiteness as the particle size increases. On the other hand, as the particle size increases, nozzle clogging due to drying is likely to occur. Therefore, heating causes non-discharging, which leads to a failure of printing.

In the present embodiment, the first head 11 discharges the first ink when the distance indicated by the two-way arrow (a) between the surface (also referred to as the nozzle surface) on which nozzles are formed on the first head 11 and the recording medium holding unit (platen 15) is 4.0 mm or more. As a result, while the recording medium to which the first ink is applied is heated, the first nozzle is prevented from being adversely affected by vaporized solvent produced during heating the recording medium, so that the nozzle of the head is prevented from being clogged. That is, this strikes a balance between discharging reliability and prevention of bleeding of printed matter.

When the distance between the nozzle surface of the first head 11 and the recording medium holding unit is less than 4.0 mm, it is not possible to strike a balance between discharging reliability and prevention of bleeding of printed matter.

Note that the liquid discharging device does not necessarily discharge ink under the above-specified conditions all the time. Any device is allowed which is capable of discharging the white ink in a state in which the distance (a) is 4.0 mm or more.

The distance between the nozzle surface of the first head 11 and the recording medium holding unit is preferably 4.5 mm or more. When the distance is 4.5 mm or more, discharging reliability can be further improved.

Moreover, the upper limit value of the distance between the surface of the first head 11 on which the first nozzles are formed and the recording medium holding unit is not particularly limited.

In the present embodiment, the heating device 40 is disposed on the recording medium holding unit. "Disposed" here includes a case in which the heating device 40 and the platen 15 are in contact with each other as separate members. In addition to this, the heating device 40 may be built in the platen 15, which is also included in "disposed".

Since the heating device 40 is mounted on the recording medium holding unit, the recording medium can be continuously heated before and after the application of the first ink, which is more effective.

The heating device 40 can be appropriately changed. For example, a device for emitting heating energy from a position away from a recording medium can be used.

In the present embodiment, the distance between the nozzle surface of the first head 11 and the recording medium holding unit is in the vertical direction of the nozzle surface and the recording medium holding unit.

The thickness of the recording medium is preferably 3.5 mm or less. When fabric is used as the recording medium, the landing accuracy is reduced due to the fluff of the fabric or the heated part of the recording medium rises close to the nozzle, which may cause heat conduction to the nozzle, leasing to non-discharging. Conversely, such phenomenon can be prevented by limiting the thickness of the recording medium to 3.5 mm or less. In other words, the distance between the first head 11 and the recording medium is preferably 1.5 mm or more.

Note that the thickness of the recording medium is measured excluding the fluff portion. Moreover, the recording medium is smoothed by a pressing member, etc. before measurement.

The recording medium is not particularly limited. Plain paper, gloss paper, special paper, cloth, etc. are usable. Also, good images can be formed on a non-permeable substrate.

The non-permeable substrate has a surface with low moisture permeability and low absorbency and includes a material having myriad of hollow spaces inside but not open to the outside. To be more quantitative, the substrate has a water-absorption amount of 10 $mL/m^2$ or less between the start of the contact and 30 $msec^{1/2}$ later according to Bristow method.

For example, plastic films such as vinyl chloride resin film, polyethylene terephthalate (PET) film, polypropylene film, polyethylene film, and polycarbonate film are suitably used as the non-permeable substrate.

The recording media are not limited to articles used as typical recording media. It is suitable to use building materials such as wall paper, floor material, and tiles, cloth for apparel such as T-shirts, textile, and leather as the recording medium. In addition, the configuration of the paths through which the recording medium is conveyed can be adjusted to use ceramics, glass, metal, etc.

Second Embodiment

Another embodiment of the liquid discharging device of the present disclosure is described below.

Description of matters common in the above-described embodiment is omitted.

Figure 8:
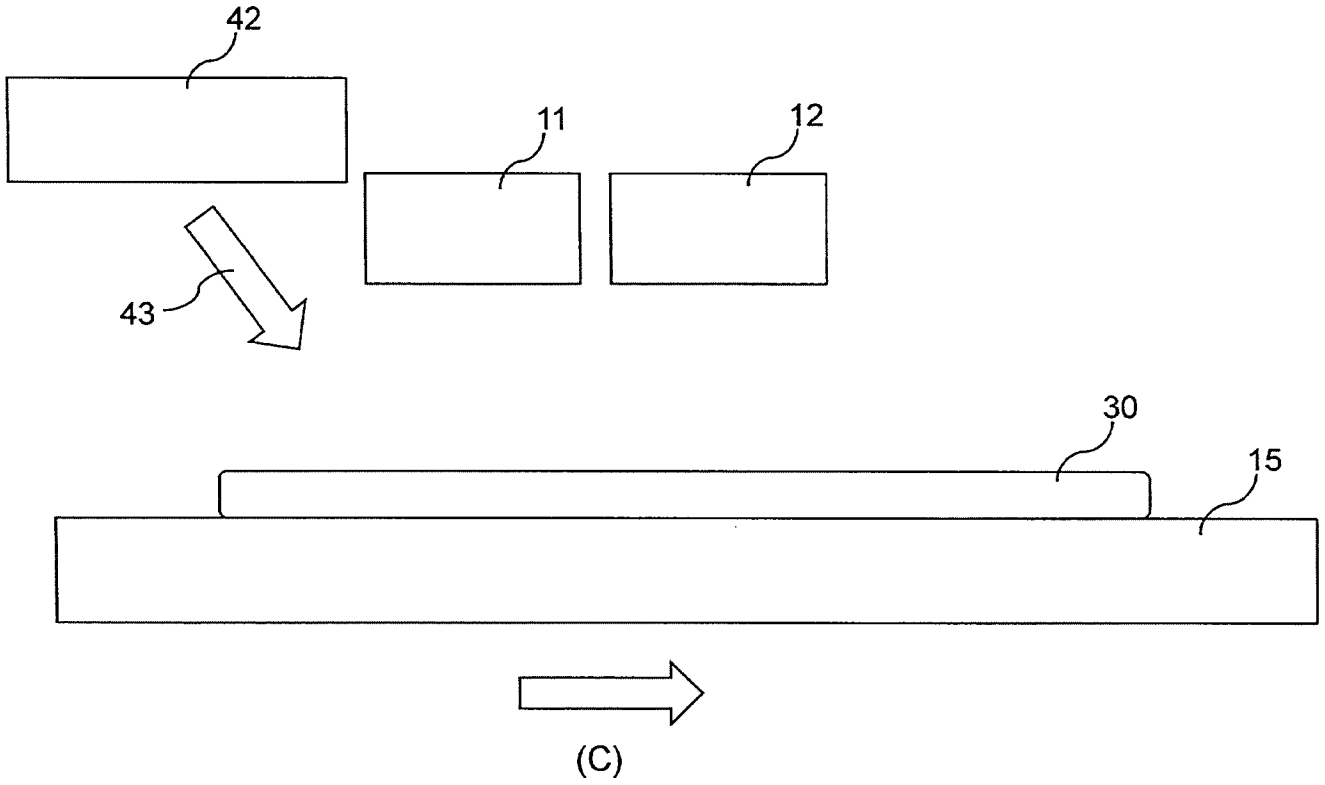
FIG. 8 is a schematic diagram illustrating a part of the liquid discharging device according to a second embodiment of the present disclosure.

FIG. 8 is a schematic diagram illustrating a side view of the liquid discharging device of the present embodiment. The liquid discharging device of the present embodiment has a different configuration of the heating device from those of the embodiments described above.

The liquid discharging device 22 of the present embodiment includes a heated wind applying device 42 that applies heated wind 43 as the heating device and is disposed away from the recording medium holding unit (the platen 15).

Also, in the present embodiment, since the first head 11 discharges the first ink in a state in which the distance between the surface of the first head 11 on which the first nozzles are formed and the recording medium holding unit is 4.0 mm or more, it is possible to prevent the first nozzle from being adversely affected by vaporized solvent produced during heating the recording medium onto which the first ink is applied. Accordingly, this makes it possible to prevent the nozzle of the head from clogging, thereby striking a balance between discharging reliability and prevention of bleeding of printed matter.

Third Embodiment

Another embodiment of the liquid discharging device of the present disclosure is described below.

Description of matters common in the above-described embodiment is omitted.

Figure 9:
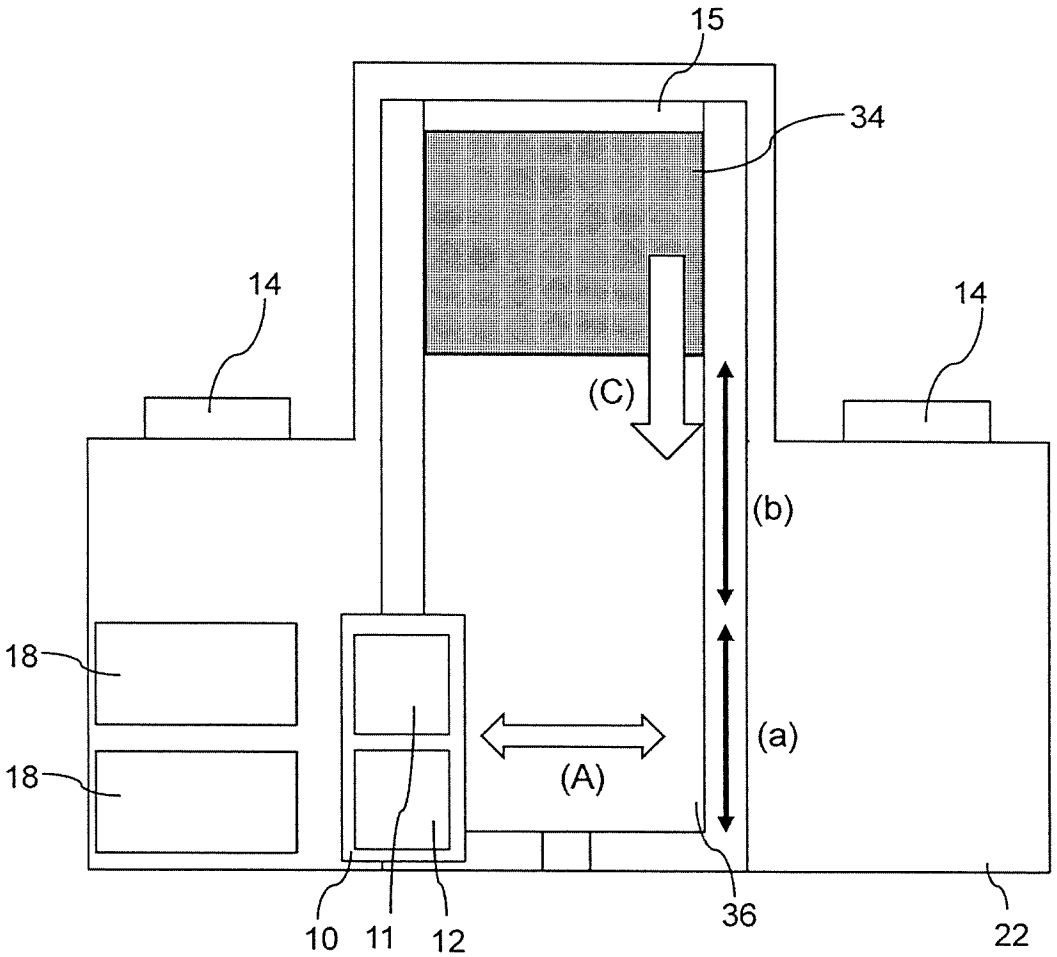
FIG. 9 is a diagram illustrating a planar view of an example of a liquid discharging device according to a third embodiment of the present disclosure.
Figure 10:
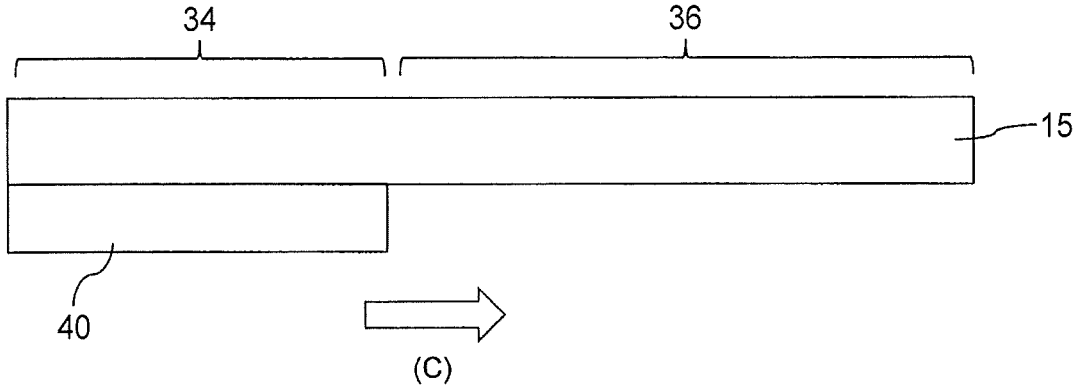
FIG. 10 is a schematic diagram illustrating side view of a part of the liquid discharging device according to a third embodiment of the present disclosure.

FIG. 9 is a schematic diagram illustrating a planar view of the liquid discharging device of the present embodiment and FIG. 10 is a schematic diagram illustrating a side view of a part of the liquid discharging device of the present embodiment. In FIGS. 9 and 10, the recording medium is omitted.

In the present embodiment, the platen 15 (recording medium holding unit) includes a first recording medium holding region 34 having the heating device 40 and a second recording medium holding region 36 without the heating device 40. The first head 11 is configured not to discharge the first ink at a position facing the first recording medium holding region 34.

In the present embodiment, the recording medium is conveyed on the recording medium holding unit, heated in the first recording medium holding region 34, and thereafter conveyed to the second recording medium holding region 36. Thereafter, the first head 11 discharges the first in the second recording medium holding region 36.

The first head 11 does not discharge the first ink at a position facing the first recording medium holding region 34, that is, the first head 11 discharges the first ink at a position facing a part of the second recording medium holding region. This makes the heat radiation to the head small, thereby improving discharging reliability.

In FIG. 10, the heating device 40 is configured to be disposed in contact with a part of the platen 15, that is, the first recording medium holding region 34. However, the configuration is not limited thereto. For example, the present embodiment also includes a case in which the heating device 40 is built in as a part of the platen 15.

As illustrated in FIG. 10, the first recording medium holding region 34 is disposed upstream of the second recording medium holding region 36 and the first head 11 in the conveyance direction of the recording medium. By heating the recording medium in the first recording medium holding region 34, it is possible to dry the first ink after the recording medium is conveyed and the first ink is discharged.

In addition, in the present embodiment, the first recording medium holding region 34 may have a temperature gradient. In this case, it is preferable that the temperature on the first recording medium holding region 34 be low on the side of the second recording medium holding region 36 and high on the opposite side to the second recording medium holding region 36. That is, it is preferable that the temperature of the first recording medium holding region 34 be high upstream of the conveyance direction C of the recording medium and low downstream of the conveyance direction C of the recording medium. Due to such a configuration, the recording medium can be firstly heated rather hot and thereafter held at lower temperatures. Therefore, the impact of the heat on the first head 11 can be further reduced.

In the present embodiment, the second recording medium holding region 36 includes a region (a) facing the first head 11 and a region (b) not facing the first head 11, which is preferably higher in temperature than the region (a) not facing the first head 11.

Depending on the material of the platen 15, there is a concern that the heat from the heating device 40 is conveyed from the first recording medium holding region 34 to the second recording medium holding region 36 and further affects the first head 11. Conversely, since the temperature in the region (a) in FIG. 9 is lower than the temperature in the region (b) in FIG. 9, the influence of heat from the first recording medium holding region 34 can be reduced. Further, the influence on the first head 11 due to heating can be further reduced.

In FIG. 9, not only the region facing the first head 11 but also the region facing the second head 12 form the region (a) facing the first head 11 in FIG. 9. Strictly, these regions can be referred to as the region facing the first head 11 and the second head 12 or the region facing the carriage 10.

Fourth Embodiment

Another embodiment of the liquid discharging device of the present disclosure is described below.

Description of matters common in the above-described embodiment is omitted.

Figure 11:
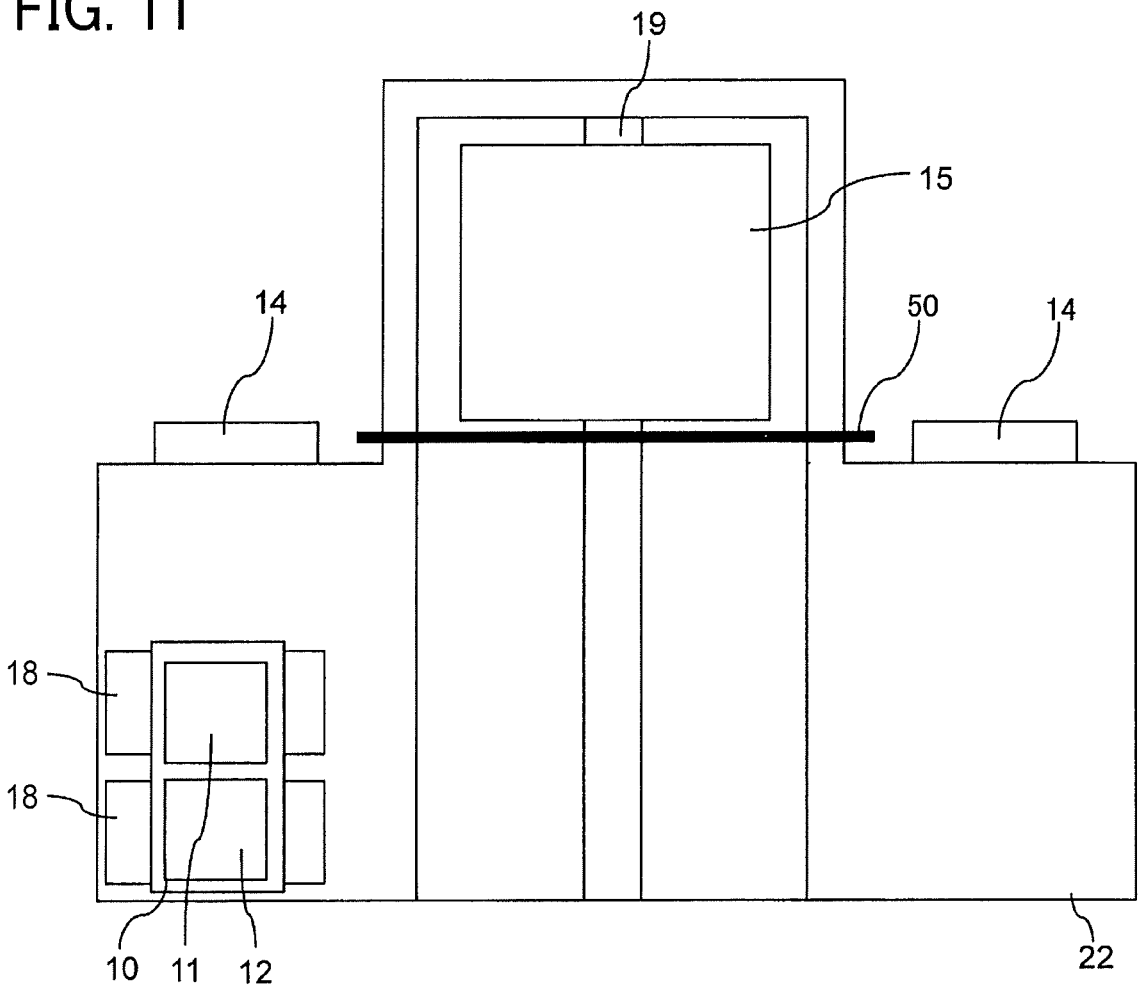
FIG. 11 is a diagram illustrating a planar view of an example of a liquid discharging device according to a fourth embodiment of the present disclosure.
Figure 12:
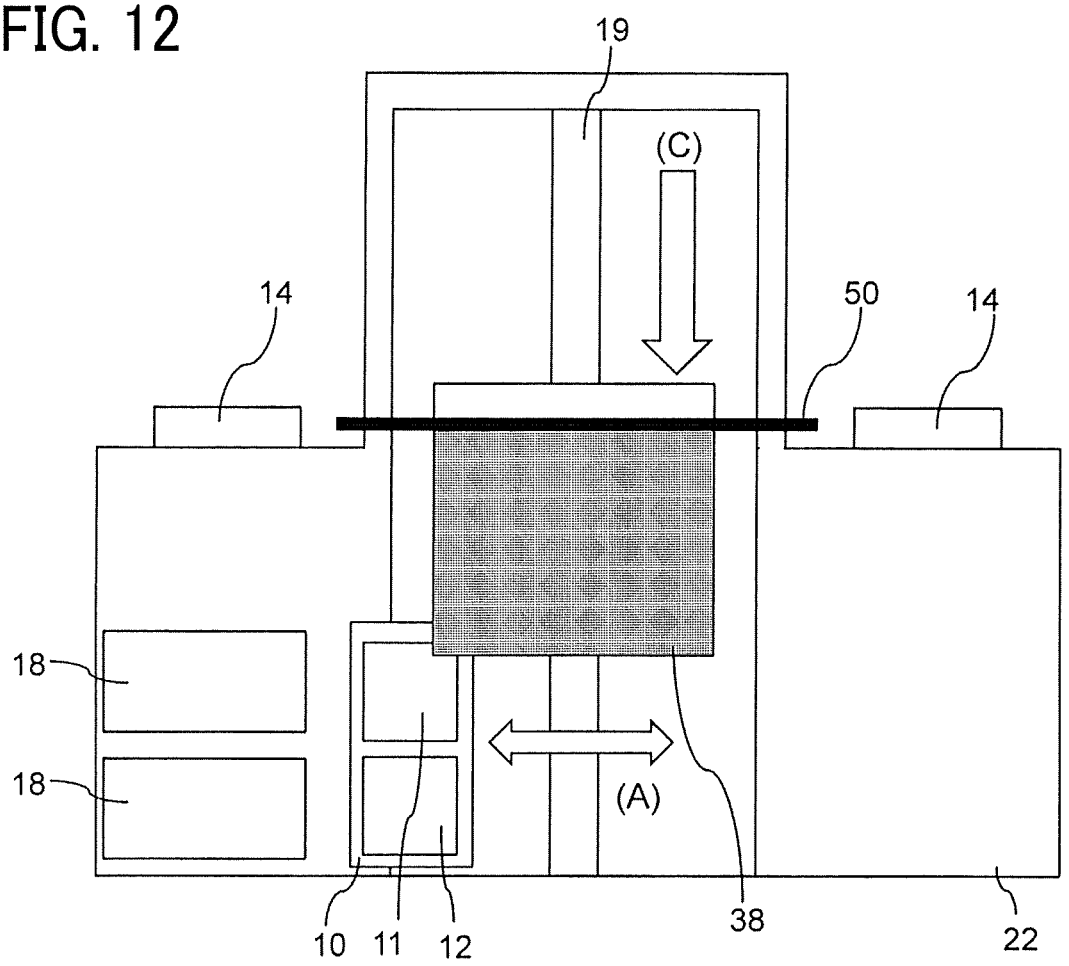
FIG. 12 is a diagram illustrating a planar view of another example of a liquid discharging device according to a fourth embodiment of the present disclosure.

FIGS. 11 and 12 are schematic diagrams illustrating side views of the liquid discharging device of the present embodiment. In FIGS. 11 and 12, the recording medium is omitted.

The liquid discharging device of the present embodiment includes a pressing member 50 configured to press the recording medium onto a part of the recording medium holding unit (platen 15) before the first head 11 discharges the first ink.

FIG. 11 is a diagram illustrating the liquid discharging device 22 before the pressing member 50 presses the recording medium and FIG. 12 is a diagram illustrating the liquid discharging device 22 in which the pressing member 50 is pressing the recording medium. In FIG. 12, the reference numeral 38 represents a pressed portion (pressed portion 38).

When fabric is used as the recording medium, the landing accuracy is reduced due to the fluff of the fabric or the heated part of the recording medium rises close to the nozzle, which may cause heat conduction to the nozzle, leasing to non-discharging. Conversely, by pressing the recording medium from the printing surface side by the pressing member 50 before the first head 11 discharges the first ink, the surface of the recording medium can be smoothed and fluff can be reduced.

Deterioration of landing accuracy and non-discharging ascribable to heat conduction to the nozzle can be prevented. It is particularly preferable that the pressing member 50 presses the recording medium during heating. This further smoothes the recording medium.

The pressing member 50 is not particularly limited, and can be changed appropriately. An example is a blade member. In addition, it is possible to press the recording medium using a pressing member.

The pressing method is not particularly limited and can be changed appropriately. For example, the pressing member 50 may move with respect to the recording medium holding unit, or the recording medium holding unit may move with respect to the pressing member 50. Alternatively, both may move.

Fifth Embodiment

Another embodiment of the liquid discharging device of the present disclosure is described below.

Description of matters common in the above-described embodiment is omitted.

Figure 13:
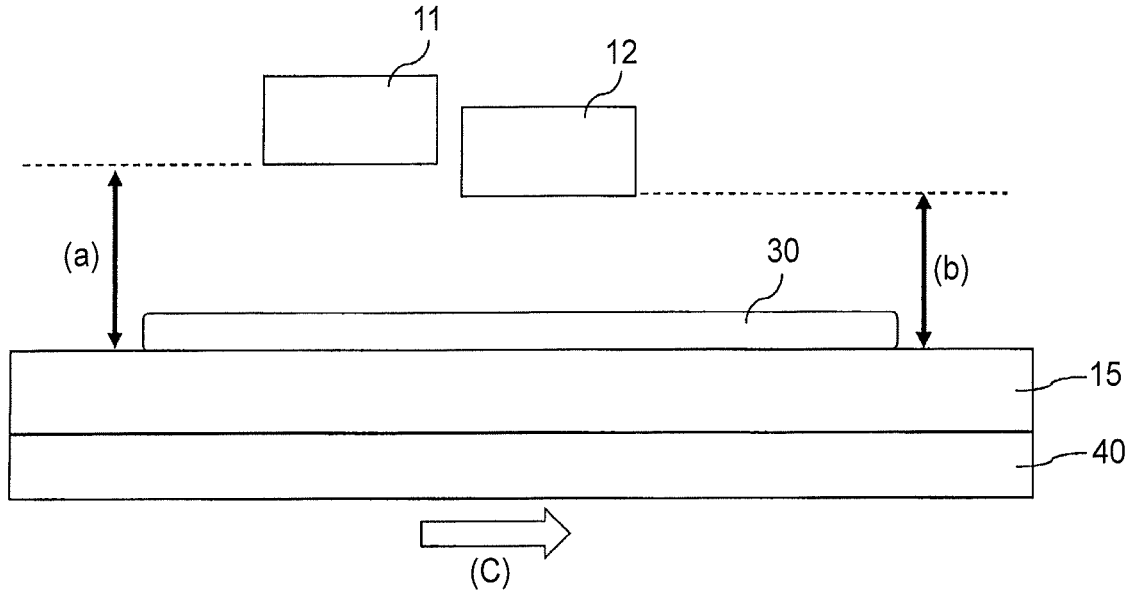
FIG. 13 is a diagram illustrating a side view of an example of a liquid discharging device according to a fifth embodiment of the present disclosure.

FIG. 13 is a schematic diagram illustrating a side view of the liquid discharging device of the present embodiment.

In the liquid discharging device of the present embodiment, a second distance (b) in FIG. 13 between a second surface of the second head 12 where second nozzles are formed and the platen 15 (recording medium holding unit) is shorter than a first distance (a) in FIG. 13 between the first surface of the first head 11 where the first nozzles are formed and the recording medium holding unit. Strictly, when the first head 11 discharges the first ink at the first distance (a) in FIG. 13, it is preferable that the second head 12 discharge the second ink at the second distance (b) in FIG. 13 which is shorter than the first distance (a) in FIG. 13.

The first ink may be applied, for example, to the entire printing region to form a backdrop. The landing accuracy is not required so much. Conversely, it is preferable that the second ink discharged by the second head 12 have a certain degree of landing accuracy. Therefore, the landing accuracy of the second ink is improved by making the distance between the second head 12 and the recording medium holding unit smaller than the distance between the first head 11 and the recording medium holding unit. In addition, since the pigment that can be contained in the second ink has a small particle size and is different from the metal oxide that can be contained in the first ink, the landing accuracy is not significantly affected by the heat if the distance between the second head 12 and the recording medium holding unit is reduced.

In FIG. 13, the heating device 40 is provided to the platen 15 at a position facing the first head 11 and the second head 12. However, the present disclosure is not limited to this configuration. The first recording medium holding region 34 and the second recording medium holding region 36 may be provided as described above.

Sixth Embodiment

Another embodiment of the liquid discharging device of the present disclosure is described below.

Description of matters common in the above-described embodiment is omitted.

Figure 14:
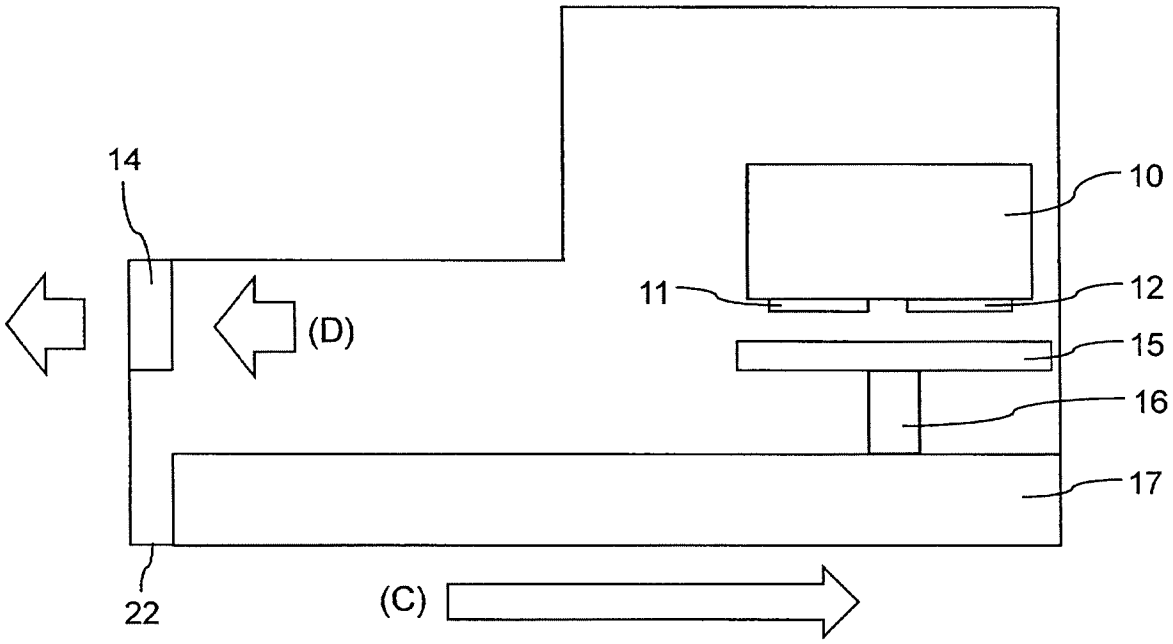
FIG. 14 is a diagram illustrating a side view of an example of a liquid discharging device according to a sixth embodiment of the present disclosure.

FIG. 14 is a schematic diagram illustrating a side view of the liquid discharging device of the present embodiment. The liquid discharging device of the present embodiment has a different configuration of the exhaust unit 14 from those of the embodiments described above.

In the present disclosure, the arrangement of the exhaust unit 14 is not particularly limited and can be changed appropriately. For example, as in the present embodiment, the exhaust unit 14 can be disposed at the edge part of the moving range of the platen 15.

Figure 15:
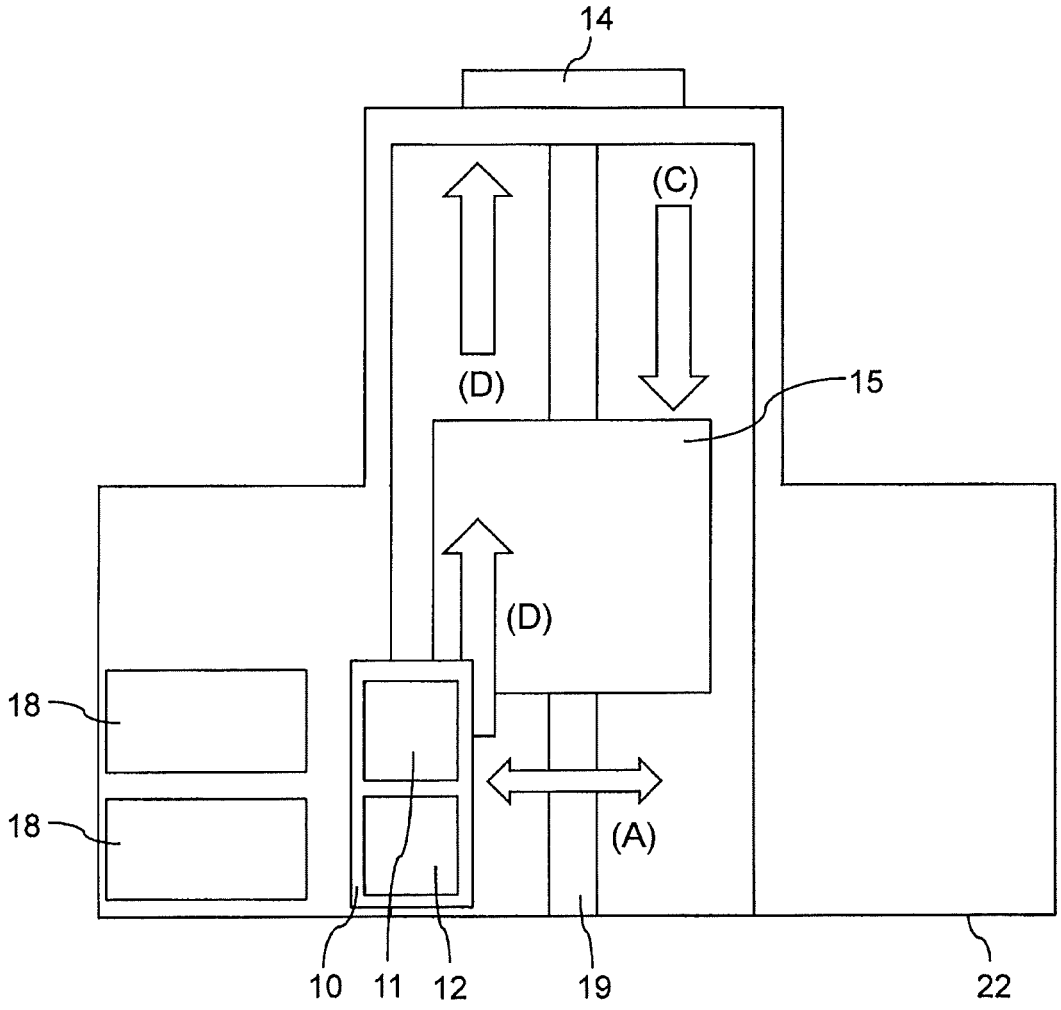
FIG. 15 is a diagram illustrating a planar view of an example of a liquid discharging device according to a sixth embodiment of the present disclosure.

FIG. 15 is a schematic diagram illustrating a planar view of the present embodiment. The direction of the gas flow D is opposite to the conveyance direction C of the recording medium. By changing the disposition of the exhaust unit 14, the direction of the gas flow (D) can be changed appropriately. In such a case, the gas between the first head and the recording medium can be caused to flow upstream in the conveyance direction of the recording medium, thereby preventing the influence of the second ink aggregation, etc.

Seventh Embodiment

Another embodiment of the liquid discharging device of the present disclosure is described below.

Description of matters common in the above-described embodiment is omitted.

In the liquid discharging device of the present embodiment, the exhaust unit is disposed upstream of the first head in the conveyance direction of the recording medium and adjacent to the first head in the conveyance direction of the recording medium.

Figure 16:
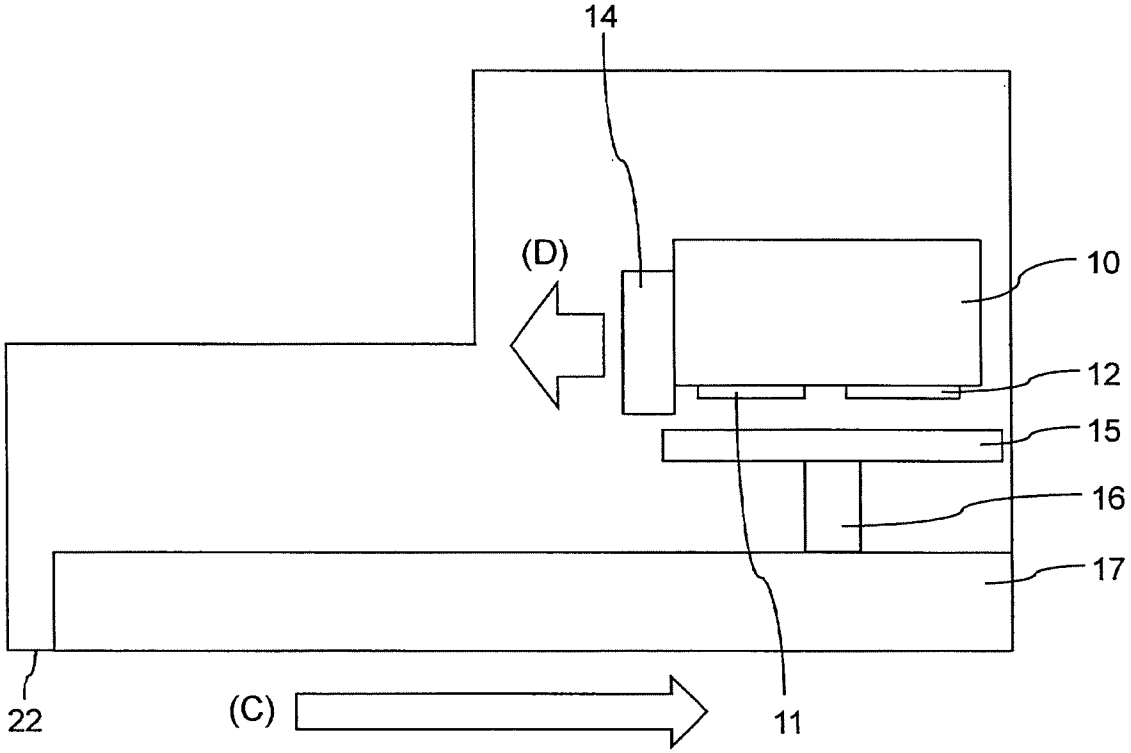
FIG. 16 is a diagram illustrating a side view of an example of a liquid discharging device according to a seventh embodiment of the present disclosure.

FIG. 16 is a schematic diagram illustrating a side view of the liquid discharging device of the present embodiment.

In the present embodiment, as illustrated in FIG. 16, the exhaust unit 14 is disposed so as to be adjacent to the first head 11 upstream in the conveyance direction of the recording medium. In the present embodiment, the exhaust unit 14 is directly mounted onto the carriage 10.

As a result, the formation of the gas flow direction is less likely to change irrespective of the position of the carriage 10 and demonstrates a more stable effect. According to the present embodiment, the gas between the first head and the recording medium can be caused to stably flow upstream in the conveyance direction of the recording medium, thereby preventing the influence of the second ink aggregation, etc.

In addition, since the distance between the exhaust unit 14 and the head is short, the gas can be caused to flow in the space between the head and the recording medium with a larger force, so that the first ink can be prevented from adhering to the head 12.

Eighth Embodiment

Another embodiment of the liquid discharging device of the present disclosure is described below.

Description of matters common in the above-described embodiment is omitted.

The liquid discharging device according to the present embodiment includes a plurality of exhaust units. Of the plurality of exhaust units, the exhaust units disposed upstream of the first head in the conveyance direction of the recording medium have a larger suction power than the rest of the plurality of exhaust units.

Figure 17:
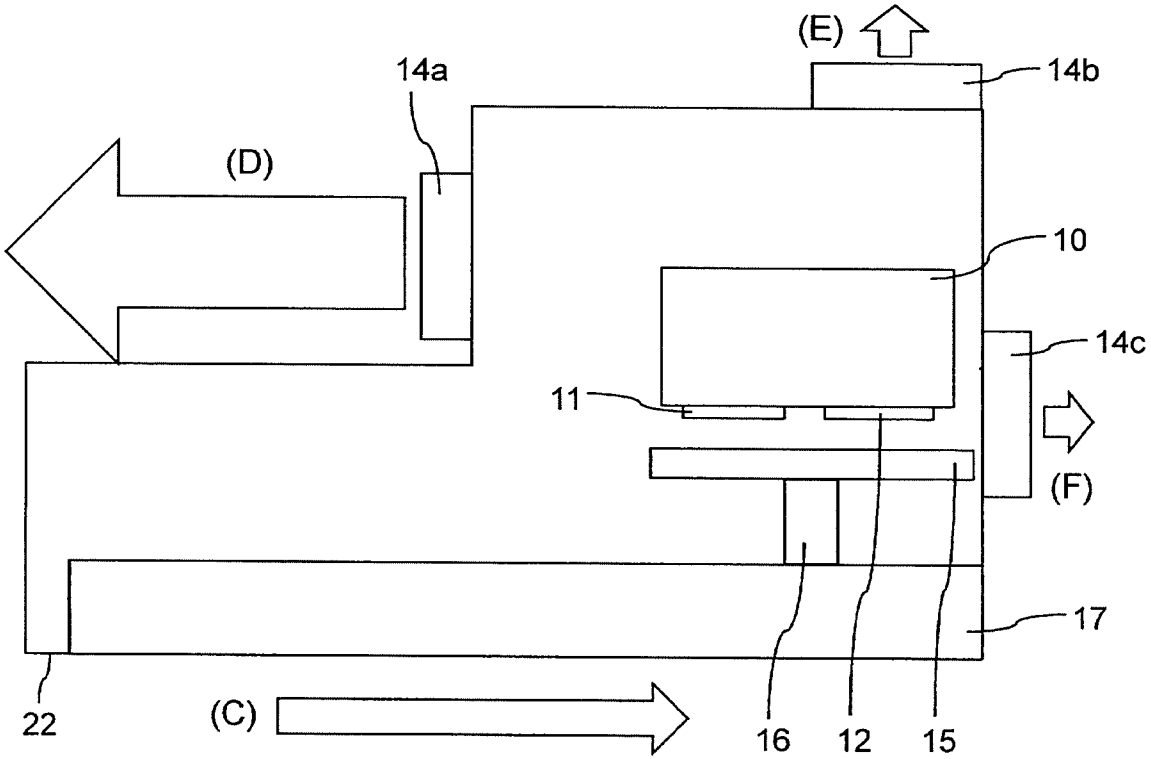
FIG. 17 is a diagram illustrating a side view of an example of a liquid discharging device according to an eighth embodiment of the present disclosure.

FIG. 17 is a schematic diagram illustrating a side view of the liquid discharging device of the present embodiment.

As in the present embodiment, the exhaust unit 14 may be provided downstream of the heads 11 and 12 in the conveyance direction of the recording medium. In this case, since it is good to flow the gas between the head and the recording medium from the second head 12 to the first head 11, for example, an exhaust unit 14*a* having a large suction power (flow rate) may be disposed upstream of the heads 11 and 12 and be set to have a larger suction power than other exhaust units 14*b* and 14*c*. As illustrated in FIG. 17, the suction power D of the exhaust unit 14*a* is larger than the total suction power E+F of the other exhaust units 14*b* and 14*c*.

As such, the gas between the first head and the recording medium can flow to the upstream side in the conveyance direction of the recording medium, so that the mist of the first ink is not likely to reach the second head 12, thereby preventing the influence of aggregation of the second ink, etc.

In general, in addition to a mist recovery fan, a large number of fans such as a heat exhaust fan, a cooling fan, and a drying fan may be arranged in the liquid discharging device can be disposed. Even in such a case, the ink aggregation can be reduced if it is configured at least as in the present embodiment.

Ninth Embodiment

Another embodiment of the liquid discharging device of the present disclosure is described below.

Description of matters common in the above-described embodiment is omitted.

Figure 18:
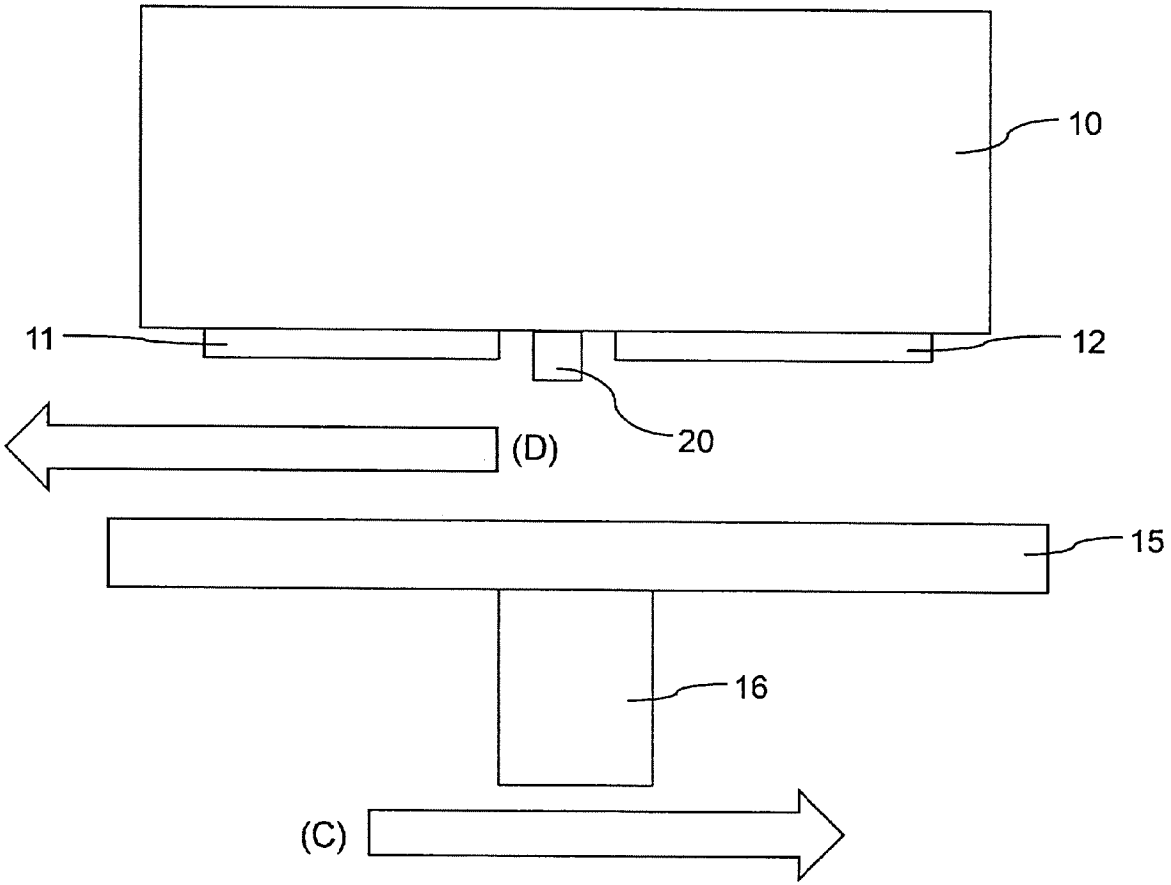
FIG. 18 is a diagram illustrating a side view of an example of a liquid discharging device according to a ninth embodiment of the present disclosure.

FIG. 18 is a schematic diagram illustrating a side view of the liquid discharging device of the present embodiment. FIG. 18 is a schematic diagram illustrating a part of the liquid discharging device.

The liquid discharging device according to the present embodiment includes a shielding member 20 disposed between the first head 11 and the second head 12 in the conveyance direction of the recording medium. Due to this shielding member 20, it is possible to further prevent the mist of the first ink from the first head 11 from reaching the second head 12.

In addition, the shielding member 20 of the present embodiment protrudes to the recording medium below the discharging surface of the first head 11. Since the lower end of the shielding member 20 protrudes downward from the head, it is possible to further prevent the mist of the first ink from reaching the second head 12.

First Ink

The first ink contains a metal oxide and other optional components such as an organic solvent, water, a coloring material, a resin, and an additive.

Metal Oxide

The metal oxide is not particularly limited. Examples are titanium oxide and zinc oxide. The proportion of the metal oxide is preferably from 0.1 to 20 percent by mass in the first ink.

Organic Solvent

There is no specific limitation to the organic solvent for use in the present disclosure. For example, water-soluble organic solvents can be used. Examples include, but are not limited to, polyols, ethers such as polyol alkylethers and polyol arylethers, nitrogen-containing heterocyclic compounds, amides, amines, and sulfur-containing compounds.

Specific examples of the polyhydric alcohol include, but are not limited to, ethylene glycol, diethylene glycol, 1,2-propanediol, 1,3-propane diol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and petriol.

Specific examples of the polyol alkyl ethers include, but are not limited to, ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Specific examples of the polyol aryl ethers include, but are not limited to, ethylene glycol monophenyl ether and ethylene glycol monobenzyl ether.

Specific examples of nitrogen-containing heterocyclic compounds include, but are not limited to, 2-pyrrolidone, N-methyl-2-pyrrolidone, N-hydroxyethyl-2-pyrrolidone, 1,3-dimethyl-2-imidazoline, ε-caprolactam, and γ-butylolactone.

Specific examples of the amide include, but are not limited to, formamide, N-methyl formamide, N,N-dimethylformamide, 3-methoxy-N,N-dimethyl propionamide, and 3-buthoxy-N,N-dimethylpropionamide.

Specific examples of the amine include, but are not limited to, monoethanol amine, diethanol amine, and triethyl amine.

Specific examples of the sulfur-containing compounds include, but are not limited to, dimethyl sulphoxide, sulfolane, and thiodiethanol.

Also, for example, propylene carbonate, ethylene carbonate, etc. can be used as the organic solvent.

To serve as a humectant and impart a good drying property, it is preferable to use an organic solvent having a boiling point of 250 degrees C. or lower.

Polyhydric alcohol compounds having eight or more carbon atoms and glycol ether compounds are also suitable as the organic solvent. Specific examples of the polyol compounds having eight or more carbon atoms include, but are not limited to, 2-ethyl-1,3-hexanediol and 2,2,4-trimethyl-1,3-pentanediol.

Specific examples of the glycolether compounds include, but are not limited to, polyol alkylethers such as ethyleneglycol monoethylether, ethyleneglycol monobutylether, diethyleneglycol monomethylether, diethyleneglycol monoethylether, diethyl eneglycol monobutylether, tetraethyl eneglycol monomethylether, and propyleneglycol monoethylether; and polyol arylethers such as ethyleneglycol monophenylether and ethyleneglycol monobenzylether.

The polyhydric alcohol compounds having eight or more carbon atoms and glycolether compounds enhance permeability of ink for paper used as a recording medium.

The proportion of the organic solvent in the ink has no particular limit and can be suitably selected to suit to a particular application.

In terms of drying property and discharging reliability of the ink, the proportion is preferably from 10 to 60 percent by mass and more preferably from 20 to 60 percent by mass.

Water

The proportion of water in the ink is not particularly limited and can be suitably selected to suit to a particular application. In terms of drying property and discharging reliability of the ink, the proportion is preferably from 10 to 90 percent by mass and more preferably from 20 to 60 percent by mass.

Coloring Material

The coloring material is not particularly limited and the same coloring material as that of the second ink described later can be used.

Resin

The type of the resin contained in the ink has no particular limit and can be suitably selected to suit to a particular application. Examples include, but are not limited to, urethane resins, polyester resins, acrylic-based resins, vinyl acetate-based resins, styrene-based resins, butadiene-based resins, styrene-butadiene-based resins, vinylchloride-based resins, acrylic styrene-based resins, and acrylic silicone-based resins.

Resin particulate made of such resins can be also used. It is possible to mix a resin emulsion in which such resin particles are dispersed in water as a dispersion medium with materials such as a coloring material and an organic solvent to obtain an ink. It is possible to use suitably-synthesized resin particulate as the resin particle. Alternatively, the resin particulate available on the market can be used. These resin particulate can be used alone or in combination.

The volume average particle diameter of the resin particle is not particularly limited and can be suitably selected to suit to a particular application. The volume average particle diameter is preferably from 10 to 1,000 nm, more preferably from 10 to 200 nm, and furthermore preferably from 10 to 100 nm to obtain good fixability and image robustness.

The volume average particle diameter can be measured by using, for example, a particle size analyzer (Nanotrac Wave-UT151, manufactured by MicrotracBEL Corp.).

The proportion of the resin in the ink is not particularly limited and can be suitably selected to suit to a particular application. In terms of fixability and storage stability of ink, it is preferably from 1 to 30 percent by mass and more preferably from 5 to 20 percent by mass to the total amount of the ink.

The particle diameter of the solid portion in the ink has no particular limit and can be selected to suit to a particular application. The maximum frequency of the particle diameter of the solid portion in the ink is preferably from 20 to 1000 nm and more preferably from 20 to 150 nm in the maximum number conversion to enhance discharging stability and image quality such as image density. The solid portion includes resin particulate, pigment particulate, etc. The particle diameter can be measured by using a particle size analyzer (Nanotrac Wave-UT151, manufactured by MicrotracBEL Corp).

Additive

The ink may further optionally include a surfactant, a defoaming agent, a preservative and fungicide, a corrosion inhibitor, a pH regulator, etc.

Surfactant

Examples of the surfactant include, but are not limited to, silicone-based surfactants, fluorochemical surfactants, amphoteric surfactants, nonionic surfactants, and anionic surfactants.

The silicone-based surfactant has no specific limit and can be suitably selected to suit to a particular application. Of these, silicone-based surfactants not decomposed even in high pH environment are preferable. The silicone-based surfactants include, for example, side chain-modified polydimethyl siloxane, both distal end-modified polydimethyl siloxane, one distal end-modified polydimethyl siloxane, and side chain both distal end-modified polydimethyl siloxane. As the modification group, it is particularly preferable to select a polyoxyethylene group or polyoxyethylene polyoxypropylene group because these demonstrate good properties as aqueous surfactants. It is possible to use a polyether-modified silicone-based surfactant as the silicone-based surfactant. A specific example is a compound in which a polyalkylene oxide structure is introduced into the side chain of the Si site of dimethyl siloxane.

Specific examples of the fluorochemical surfactant include, but are not limited to, perfluoroalkyl sulfonic acid compounds, perfluoroalkyl carboxylic acid compounds, ester compounds of perfluoroalkyl phosphoric acid, adducts of perfluoroalkyl ethylene oxide, and polyoxyalkylene ether polymer compounds having a perfluoroalkyl ether group in its side chain. These are particularly preferable because the fluorochemical surfactant does not easily produce foams.

Specific examples of the perfluoroalkyl sulfonic acid compounds include, but are not limited to, a perfluoroalkyl sulfonic acid and a salt of perfluoroalkyl sulfonic acid. Specific examples of the perfluoroalkyl carboxylic acid compounds include, but are not limited to, a perfluoroalkyl carboxylic acid and a salt of perfluoroalkyl carboxylic acid. Specific examples of the polyoxyalkylene ether polymer compounds having a perfluoroalkyl ether group in its side chain include, but are not limited to, sulfuric acid ester salts of polyoxyalkylene ether polymer having a perfluoroalkyl ether group in its side chain, and salts of polyoxyalkylene ether polymers having a perfluoroalkyl ether group in its side chain. Counter ions of salts in these fluorochemical surfactants are, for example, Li, Na, K, $NH_4$, $NH_3CH_2CH_2OH$, $NH_2(CH_2CH_2OH)_2$, and $NH(CH_2CH_2OH)_3$.

Specific examples of the amphoteric surfactants include, but are not limited to, lauryl aminopropionic acid salts, lauryl dimethyl betaine, stearyl dimethyl betaine, and lauryl dihydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan aliphatic acid esters, polyoxyethylene sorbitan aliphatic acid esters, and adducts of acetylene alcohol with ethylene oxides.

Specific examples of the anionic surfactants include, but are not limited to, polyoxyethylene alkyl ether acetates, dodecyl benzene sulfonates, laurates, and polyoxyethylene alkyl ether sulfates.

These can be used alone or in combination.

The silicone-based surfactant has no particular limit and can be suitably selected to suit to a particular application. Specific examples include, but are not limited to, side-chain-modified polydimethyl siloxane, both distal-end-modified polydimethylsiloxane, one-distal-end-modified polydimethylsiloxane, and side-chain-both-distal-end-modified polydimethylsiloxane. In particular, a polyether-modified silicone-based surfactant having a polyoxyethylene group or a polyoxyethylene polyoxypropylene group is particularly preferable because such a surfactant demonstrates good property as an aqueous surfactant.

Any suitably synthesized surfactant and any product available on the market is suitable. Products available on the market can be obtained from BYK-Chemie GmbH, Shin-Etsu Chemical Co., Ltd., Dow Corning Toray Co., Ltd., NIHON EMULSION Co., Ltd., Kyoeisha Chemical Co., Ltd., etc.

The polyether-modified silicon-based surfactant has no particular limit and can be suitably selected to suit to a particular application. For example, a compound is usable in which the polyalkylene oxide structure represented by the following Chemical formula S-1 is introduced into the side chain of the Si site of dimethyl polysiloxane.

Chemical formula S-1

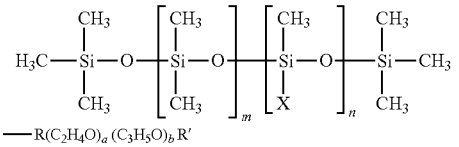

$X = —R(C_2H_4O)_a(C_3H_5O)_bR'$

In Chemical formula S-1, "m", "n", "a", and "b" each, respectively independently represent integers, R represents an alkylene group, and R' represents an alkyl group.

Specific examples of polyether-modified silicone-based surfactants include, but are not limited to, KF-618, KF-642, and KF-643 (all manufactured by Shin-Etsu Chemical Co., Ltd.), EMALEX-SS-5602 and SS-1906EX (both manufactured by NIHON EMULSION Co., Ltd.), FZ-2105, FZ-2118, FZ-2154, FZ-2161, FZ-2162, FZ-2163, and FZ-2164 (all manufactured by Dow Corning Toray Co., Ltd.), BYK-33 and BYK-387 (both manufactured by BYK Chemie GmbH), and TSF4440, TSF4452, and TSF4453 (all manufactured by Momentive Performance Materials Inc.).

The fluorochemical surfactant is preferably a compound having 2 to 16 fluorine-substituted carbon atoms and more preferably a compound having 4 to 16 fluorine-substituted carbon atoms.

Specific examples of the fluorochemical surfactants include, but are not limited to, perfluoroalkyl phosphoric acid ester compounds, adducts of perfluoroalkyl ethylene oxide, and polyoxyalkylene ether polymer compounds having a perfluoroalkyl ether group in its side chain. Of these, polyoxyalkylene ether polymer compounds having a perfluoroalkyl ether group in the side chain thereof are preferable because these polymer compounds do not easily foam and the fluorosurfactant represented by the following Chemical formula F-1 or Chemical formula F-2 is more preferable.

$$CF_3CF_2(CF_2CF_2)_m—CH_2CH_2O(CH_2CH_2O)_nH \quad \text{Chemical formula F-1}$$

In the compound represented by Chemical formula F-1, m is preferably 0 or an integer of from 1 to 10 and n is preferably 0 or an integer of from 1 to 40.

$$C_pF_{2n+1}—CH_2CH(OH)CH_2—O—(CH_2CH_2O)_a—Y \quad \text{Chemical formula F-2}$$

In the compound represented by the chemical formula F2, Y represents H or $C_mF_{2m+1}$, where m represents an integer of from 1 to 6, or $CH_2CH(OH)CH_2—C_mF_{2m+1}$, where m represents an integer of from 4 to 6, or $C_pH_{2p+1}$, where p is an integer of from 1 to 19. "n" represents an integer of from 1 to 6. "a" represents an integer of from 4 to 14.

As the fluorochemical surfactant, products available on the market may be used.

Specific examples include, but are not limited to, SURFLON S-111, S-112, S-113, S-121, S-131, S-132, S-141, and S-145 (all manufactured by ASAHI GLASS CO., LTD.); FLUORAD FC-93, FC-95, FC-98, FC-129, FC-135, FC-170C, FC-430, and FC-431 (all manufactured by SUMITOMO 3M); MEGAFACE F-470, F-1405, and F-474 (all manufactured by DIC CORPORATION); ZONYL TBS, FSP, FSA, FSN-100, FSN, FSO-100, FSO, FS-300, UR, and Capstone™ FS-30, FS-31, FS-3100, FS-34, and FS-35 (all manufactured by The Chemours Company); FT-110, FT-250, FT-251, FT-400S, FT-150, and FT-400SW (all manufactured by NEOS COMPANY LIMITED); POLYFOX PF-136A, PF-156A, PF-151N, PF-154, and PF-159 (manufactured by OMNOVA SOLUTIONS INC.); and UNIDYNE™ DSN-403N (manufactured by DAIKIN INDUSTRIES, Ltd.). Of these, in terms of improvement on print quality, in particular coloring property and permeability, wettability, and uniform dying property on paper, FS-3100, FS-34, and FS-300 of The Chemours Company, FT-110, FT-250, FT-251, FT-400S, FT-150, and FT-400SW of NEOS COMPANY LIMITED, POLYFOX PF-151N of OMNOVA SOLUTIONS INC., and UNIDYNE™ DSN-403N (manufactured by DAIKIN INDUSTRIES, Ltd.) are particularly preferable.

The proportion of the surfactant in the ink is not particularly limited and can be suitably selected to suit to a particular application. For example, the proportion is preferably from 0.001 to 5 percent by mass and more preferably from 0.05 to 5 percent by mass in terms of excellent wettability and discharging stability and improvement on image quality.

Defoaming Agent

The defoaming agent has no particular limit. For example, silicon-based defoaming agents, polyether-based defoaming agents, and aliphatic acid ester-based defoaming agents are suitable. These can be used alone or in combination. Of these, silicone-based defoaming agents are preferable in terms of the effect of foam breaking.

Preservatives and Fungicides

The preservatives and fungicides are not particularly limited. A specific example is 1,2-benzisothiazoline-3-one.

Corrosion Inhibitor

The corrosion inhibitor has no particular limitation. Specific examples include, but are not limited to, acid sulfites and sodium thiosulfates.

pH Regulator

The pH regulator has no particular limit as long as it can control pH to not lower than 7. Specific examples include, but are not limited to, amines such as diethanol amine and triethanol amine.

Property of Ink

Properties of the ink are not particularly limited and can be suitably selected to suit to a particular application. For example, viscosity, surface tension, and pH are preferably in the following ranges.

Viscosity of the ink at 25 degrees C. is preferably from 5 to 30 mPa·s and more preferably from 5 to 25 mPa·s to improve print density and text quality and obtain good dischargeability. Viscosity can be measured by, for example, a rotatory viscometer (RE-80L, manufactured by TOKI SANGYO CO., LTD.). The measuring conditions are as follows:

Standard cone rotor (1°34'×R24)

Sample liquid amount: 1.2 mL

Rotational frequency: 50 rotations per minute (rpm)

25 degrees C.

Measuring time: three minutes.

The surface tension of the ink is preferably 35 mN/m or less and more preferably 32 mN/m or less at 25 degrees C. in terms that the ink is suitably leveled on a recording medium and the drying time of the ink is shortened.

pH of the ink is preferably from 7 to 12 and more preferably from 8 to 11 in terms of prevention of corrosion of metal material in contact with liquid.

Second Ink

The second ink contains a coloring material and other optional components such as an organic solvent, water, a coloring material, a resin, and an additive. Descriptions of articles similar to those of the first ink are omitted.

Coloring Material

The coloring material has no particular limit. For example, pigments and dyes are suitable.

As the pigment, inorganic pigments or organic pigments can be used. These can be used alone or in combination. In addition, it is possible to use a mixed crystal as the pigment.

As the pigments, for example, black pigments, yellow pigments, magenta pigments, cyan pigments, white pigments, green pigments, orange pigments, and gloss pigments and metallic pigments of gold, silver, etc., can be used.

As the inorganic pigments, in addition to titanium oxide, iron oxide, calcium carbonate, barium sulfate, aluminum hydroxide, barium yellow, cadmium red, and chrome yellow, carbon black manufactured by known methods such as contact methods, furnace methods, and thermal methods can be used.

As the organic pigments, it is possible to use azo pigments, polycyclic pigments (phthalocyanine pigments, perylene pigments, perinone pigments, anthraquinone pigments, quinacridone pigments, dioxazine pigments, indigo pigments, thioindigo pigments, isoindolinone pigments, and quinophthalone pigments, etc.), dye chelates (basic dye type chelates, acid dye type chelates, etc.), nitro pigments, nitroso pigments, and aniline black can be used. Of those pigments, pigments having good affinity with solvents are preferable. Also, hollow resin particles and hollow inorganic particles can be used.

Specific examples of the pigments for black include, but are not limited to, carbon black (C.I. Pigment Black 7) such as furnace black, lamp black, acetylene black, and channel black, metals such as copper, iron (C.I. Pigment Black 11), and titanium oxide, and organic pigments such as aniline black (C.I. Pigment Black 1).

Specific examples of the pigments for color include, but are not limited to, C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2, 48:2 {Permanent Red 2B(Ca)}, 48:3, 48:4, 49:1, 52:2, 53:1, 57:1 (Brilliant Carmine 6B), 60:1, 63:1, 63:2, 64:1, 81, 83, 88, 101 (rouge), 104, 105, 106, 108 (Cadmium Red), 112, 114, 122 (Quinacridone Magenta), 123, 146, 149, 166, 168, 170, 172, 177, 178, 179, 184, 185, 190, 193, 202, 207, 208, 209, 213, 219, 224, 254, and 264; C.I. Pigment Violet 1 (Rhodamine Lake), 3, 5:1, 16, 19, 23, and 38; C.I. Pigment Blue 1, 2, 15 (Phthalocyanine Blue), 15:1, 15:2, 15:3, 15:4, (Phthalocyanine Blue), 16, 17:1, 56, 60, and 63; C.I. Pigment Green 1, 4, 7, 8, 10, 17, 18, and 36.

The dye is not particularly limited and includes, for example, acidic dyes, direct dyes, reactive dyes, basic dyes. These can be used alone or in combination.

Specific examples of the dye include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C. I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the coloring material in the ink is preferably from 0.1 to 15 percent by mass and more preferably from 1 to 10 percent by mass in terms of enhancement of image density, fixability, and discharging stability.

To obtain an ink by dispersing a pigment, for example, a hydrophilic functional group is introduced into a pigment to prepare a self-dispersible pigment, the surface of a pigment is coated with a resin followed by dispersion, or a dispersant is used to disperse a pigment.

To prepare a self-dispersible pigment by introducing a hydrophilic functional group into a pigment, for example, it is possible to add a functional group such as a sulfone group and a carboxyl group to the pigment (e.g., carbon) to disperse the pigment in water.

To coat the surface of a pigment with a resin, the pigment is encapsulated by microcapsules to make the pigment dispersible in water. This can be referred to as a resin-coated pigment. In this case, all the pigments to be added to ink are not necessarily entirely coated with a resin. Pigments partially or wholly uncovered with a resin are allowed to be dispersed in the ink unless such pigments have an adverse impact.

In a method of using a dispersant to disperse a pigment, for example, a known dispersant having a small molecular weight or a large molecular weight, which is represented by a surfactant, is used to disperse the pigment in ink.

As the dispersant, it is possible to use, for example, an anionic surfactant, a cationic surfactant, a nonionic surfactant, an amphoteric surfactant, etc. depending on a pigment.

Also, a nonionic surfactant (RT-100, manufactured by TAKEMOTO OIL & FAT CO., LTD.) and a formalin condensate of naphthalene sodium sulfonate are suitable as the dispersant.

Those can be used alone or in combination.

Pigment Dispersion

The ink can be obtained by mixing a pigment with materials such as water and an organic solvent. It is also possible to mix the pigment with water, a dispersant, etc., to prepare a pigment dispersion and thereafter mix the pigment dispersion with material such as water and an organic solvent to manufacture the ink.

The pigment dispersion is obtained by mixing and dispersing water, a pigment, a pigment dispersant, and other optional components and controlling the particle size. It is good to use a dispersing device for dispersion.

The particle diameter of the pigment in the pigment dispersion has no particular limit. For example, the maximum frequency is preferably from 20 to 500 nm and more preferably from 20 to 150 nm in the maximum number conversion to improve dispersion stability of the pigment and ameliorate discharging stability and the image quality such as image density. The particle diameter of the pigment can be measured using a particle size analyzer (Nanotrac Wave-UT151, manufactured by MicrotracBEL Corp).

In addition, the proportion of the pigment in the pigment dispersion is not particularly limited and can be suitably selected to suit a particular application. In terms of improving discharging stability and increasing image density, the proportion is preferably from 0.1 to 50 percent by mass and more preferably from 0.1 to 30 percent by mass.

It is preferable that the pigment dispersion be filtered with a filter, a centrifuge, etc., to remove coarse particles followed by degassing.

Pre-Processing Fluid

The pre-processing fluid includes a flocculant, an organic solvent, water, and optional materials such as a surfactant, a defoaming agent, a pH regulator, a preservatives and fungicides, and a corrosion inhibitor.

The organic solvent, the surfactant, the defoaming agent, the pH regulator, the preservatives and fungicides, and the corrosion inhibitor can be the same material as those for use in the ink. Also, other material for use in known processing fluid can be used.

The type of the flocculant is not particularly limited. For example, water-soluble cationic polymers, acids, and multivalent metal salts are suitable.

Post-Processing Fluid

The post-processing fluid has no particular limit. It is preferable that the post-processing fluid can form a transparent layer. Material such as organic solvents, water, resins, surfactants, defoaming agents, pH regulators, preservatives and fungicides, corrosion inhibitors, etc. is suitably selected based on a necessity basis and mixed to obtain the post-processing fluid. The post-processing fluid can be applied to the entire recording area formed on a recording medium or only the area on which an ink image is formed.

Having generally described preferred embodiments of this disclosure, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, embodiments of the present disclosure are described in detail with reference to Examples and Comparative Examples but are not limited thereto. "Part" means "part by mass".

Manufacturing of Liquid Dispersion 1 of Resin Particle

In a four-necked flask equipped with a stirrer, a reflux condenser, a thermometer, and a nitrogen blowing tube, 70 g of polycarbonate polyol (Duranol T5651, manufactured by Asahi Kasei Chemicals Corporation) having a number average molecular weight (Mn) of 1,000, 80 g of dicyclohexylmethane diisocyanate (H12MDI), and 180 g of acetone were reacted at 75 degrees C. for four hours to obtain an acetone solution of urethane prepolymer. This solution was cooled down to 40 degrees C. Thereafter, 400 g of water was gradually added. The resultant was subject to emulsification dispersion using a homogenizer. Thereafter, an aqueous solution in which 12 g of 2-methyl-1,5-pentanediamine was dissolved in 90 g of water was added to continue stirring for one hour. The solvent was removed at 50 degrees C. under a reduced pressure to obtain a liquid dispersion 1 of resin particle having a nonvolatile proportion of about 45 percent.

Manufacturing of Liquid Dispersion 2 of Resin Particle

In a four-necked flask equipped with a stirrer, a reflux condenser, a thermometer, and a nitrogen blowing tube, 75 g of polycarbonate polyol (Duranol T5651, manufactured by Asahi Kasei Chemicals Corporation) having a number average molecular weight (Mn) of 1,000, 10.0 g of dimethylol propionic acid, 60 g of dicyclohexylmethane diisocyanate (H12MDI), and 140 g of acetone were reacted at 75 degrees C. for four hours to obtain an acetone solution of urethane prepolymer. This solution was cooled down to 40 degrees C. and neutralized with 7 g of triethylamine. Thereafter, 450 g of water was gradually added and emulsified and dispersed using a homogenizer. Thereafter, an aqueous solution in which 7 g of 2-methyl-1,5-pentanediamine was dissolved in 50 g of water was added to continue stirring for one hour. The solvent was removed at 50 degrees C. under a reduced pressure to obtain a liquid dispersion 2 of resin particle 2 having a nonvolatile proportion of about 28 percent.

Preparation of Pre-Processing Fluid

Pre-processing fluid was prescribed based on the following prescription and thereafter mixed and stirred followed by filtration using a filter having a pore diameter of 0.8 μm (Minisart®, manufactured by Sartorius Stedim Biotech GmbH).

| | |
|---|---|
| Propylene glycol: | 20 parts |
| Surfinol 104 (acetylene glycol surfactant, manufactured by Nissin Chemical Industry Co., Ltd.): | 1 part |
| Magnesium chloride hexahydrate: | 10 parts |
| Liquid dispersion 1 of resin particle: | 15 parts |
| Proxel XLII (manufactured by Arch Chemical, Inc.): | 0.3 parts |
| Envirogem AD01 (manufactured by Air Products and Chemicals, Inc.): | 0.5 parts |

-continued

| | |
|---|---|
| Deionized water: | rest (to be a total of 100 parts) |

Preparation of Titanium Dioxide Liquid Dispersion 20.0 parts of acrylic copolymer (dispersant, DISPERBYK-2008, amine value of 66 mgKOH/g, effective component of 100 percent by mass, manufactured by Byc Chemie Japan Co., Ltd.) was dissolved in 71.0 parts of pure water in a beaker. 17.0 parts of titanium dioxide (JR-600A, number average primary particle diameter of 250 nm, surface treatment: Al, manufactured by TAYCA CORPORATION) was further added thereto. While being cooled down in water, the mixture was dispersed by a homogenizer (HG30, C20 cutter, 8,000 rpm, 60 minutes, manufactured by Hitachi Kofi Co., Ltd.). The thus-obtained pigment liquid dispersion of titanium dioxide was filtrated by a membrane filter having an average opening of 5 μm (cellulose acetate membrane) to prepare a liquid dispersion of titanium dioxide (particle concentration of titanium dioxide of 15 percent by mass).

Preparation of Liquid Dispersion of Black Pigment

The following recipe was preliminarily mixed and thereafter subjected to circulation dispersion for seven hours with a disk-type bead mill (KDL type, media: zirconia ball having a diameter of 0.3 mm, manufactured by SHINMARU ENTERPRISES CORPORATION) to obtain a liquid dispersion of black pigment (pigment concentration of 15 percent by mass).

| | |
|---|---|
| Carbon black pigment (Carbon black #2300, manufactured by Mitsubishi Chemical Corporation)): | 15 parts |
| Anionic surfactant (Pionine A-51-B, manufactured by TAKEMOTO OIL & FAT Co., Ltd.) | 2 parts |
| Deionized water: | 83 parts |

Preparation of First Ink

After dissolving materials of the following formulation other than the liquid dispersion of titanium dioxide and the liquid dispersion 2 of resin particle in deionized water to prepare a vehicle, the vehicle was mixed with the liquid dispersion 2 of resin particle and finally with the liquid dispersion of titanium dioxide followed by filtration with a filter having an average pore size of 0.8 μm to obtain a first ink.

| | |
|---|---|
| Liquid dispersion of titanium dioxide: | 30.0 parts |
| Liquid dispersion 2 of resin particle: | 30.0 parts |
| Propylene glycol: | 15 parts |
| Diethylene glycol: | 10.0 parts |
| Surfinol 104 (acetylene glycol surfactant, manufactured by Nissin Chemical Industry Co., Ltd.): | 1.0 part |
| Proxel XLII (manufactured by Arch Chemical, Inc): | 0.3 parts |
| Enviromem AD01 (manufactured by Air Products and Chemicals, Inc.): | 0.5 parts |
| Deionized water: | balance (to be a total of 100 parts) |

Preparation of Second Ink

After dissolving materials of the following formulation other than the liquid dispersion of black pigment and the liquid dispersion 2 of resin particle in deionized water to prepare a vehicle, the vehicle was mixed with the liquid dispersion 2 of resin particle and finally with the liquid dispersion of black pigment followed by filtration with a filter having an average pore size of 0.8 μm to obtain a first ink.

| | |
|---|---|
| Liquid dispersion of black pigment: | 30.0 parts |
| Liquid dispersion 2 of resin particle: | 30.0 parts |
| Propylene glycol: | 15 parts |
| Triethylene glycol: | 10.0 parts |
| Surfinol 104 (acetylene glycol surfactant, manufactured by Nissin Chemical Industry Co., Ltd.): | 1.0 part |
| Proxel XLII (manufactured by Arch Chemical, Inc.): | 0.3 parts |
| Enviromem AD01 (manufactured by Air Products and Chemicals, Inc.): | 0.5 parts |
| Deionized water: | balance (to be a total of 100 parts) |

Examples 1 to 4 and Comparative Examples 1 and 2

In Examples 1, 3, and 4, the liquid discharging device of the fifth embodiment (FIG. 13) was used. In Example 2 and Comparative Examples 1 and 2, the liquid discharging device of the first embodiment (FIG. 7, etc.) was used. The distance between the first head and the platen and the distance between the second head and the platen were changed as shown in Table 1 below.

In Examples and Comparative Examples, an inkjet printer (remodeled machine based on IPSiO GXe5500, manufactured by Ricoh Co., Ltd.) was used and the configuration thereof was changed for each of Examples and Comparative Examples. In addition, the pre-processing liquid was configured to be applied separately from the first head and the second head.

Each Example and the Comparative Example were evaluated on the following.

Discharging Reliability

The liquid discharging device of the above-described embodiments was filled with the first ink to evaluate the dischargeability after printing.

First, in an environment of 25 degrees C. and 20 percent RH, the head was cleaned in response to a printer maintenance command, a test chart was printed, and all the channels of the nozzles were confirmed to be in a discharge state.

Next, the heating device was set to 50 degrees C. and solid images were continuously printed for one hour. Thereafter, the head was cleaned once in response to a printer maintenance command, and the test chart was printed again. The number of non-discharging channels was counted from the test chart before and after being left, and evaluated according to the following criteria.

Evaluation Criteria

A: Number of non-discharging channels was less than 3

B: Number of non-discharging channels was from 3 to less than 10

C: Number of non-discharging channels was 10 or more

Evaluation of Bleeding of Plastic Film

The liquid discharging device of the above-described embodiments was filled with the first ink and the second ink and the pre-processing fluid was uniformly applied to the corona-treated surface of pyrene film (P2111, manufactured TOYOBO CO., LTD.) having a thickness of 20 μm in an attachment amount of 0.5 mg/cm$^2$. Thereafter, while the pre-processing fluid was left undried, the first ink was discharged to form a solid image in an attachment amount of 2.0 mg/cm$^2$. Immediately thereafter, the second ink was applied to the solid image of the first ink in an attachment amount of 1.0 mg/cm$^2$ to form a solid image of the second ink having a region smaller than that of the solid image of the first ink. Furthermore, the image was subjected to drying in a heated air circulation thermostatic chamber set to 100 degrees for one minute to obtain an image for evaluation.

The boundary between the solid image of the first ink and the solid image of the second ink in the obtained image for evaluation was evaluated according to the following criteria.

Evaluation Criteria

A: Clear without bleeding at boundary

B: Slight bleeding at boundary without practical problem

C: Significant bleeding recognized at boundary, not practically usable

Evaluation on Bleeding on Fabric

The liquid discharging device of the above-described embodiments was filled with the first ink and the second ink and the pre-processing fluid was uniformly applied to a cotton T-shirt (Printstar 00085-CVT, black, thickness of about 1 μm, manufactured by TOMS CO., LTD.) in an attachment amount of 3.0 mg/cm$^2$. Thereafter, while the pre-processing fluid was left undried, the first ink was discharged to form a solid image in an attachment amount of 15.0 mg/cm$^2$. Immediately thereafter, the second ink was applied to the solid image of the first ink in an attachment amount of 1.5 mg/cm$^2$ to form a solid image of the second ink having a region smaller than that of the solid image of the first ink. Furthermore, the solid image was subjected to drying by heat press set to 160 degrees C. for one minute to obtain an image for evaluation.

The thickness of the cotton T-shirt was measured after flattening with a pressing member. The portion excluding the fluffy portion was defined as the thickness of the recording medium.

The boundary between the solid image of the first ink and the solid image of the second ink in the obtained image for evaluation was evaluated according to the following criteria.

Evaluation Criteria

A: Clear without bleeding at boundary

B: Slight bleeding at boundary without practical problem

C: Significant bleeding recognized at boundary, not practically usable

The obtained data are shown in Table 1.

TABLE 1

| | Distance between first head and platen | Distance between second head and platen | Discharging reliability | Plastic film bleeding | Fabric bleeding |
|---|---|---|---|---|---|
| Example 1 | 4.0 mm | 2.0 mm | B | A | A |
| Example 2 | 4.0 mm | 4.0 mm | B | B | B |
| Example 3 | 4.5 mm | 3.0 mm | A | A | A |
| Example 4 | 5.0 mm | 3.0 mm | A | A | A |
| Comparative Example 1 | 2.0 mm | 2.0 mm | C | A | A |
| Comparative Example 2 | 2.0 mm | 2.0 mm | A | C | C |

* In Comparative Example 2, the temperature was not set by the heating device but by room temperature.

As shown in the result of Comparative Example 2, without a heating device, the second ink is applied over before the first ink dries, so that bleeding occurs.

In Comparative Example 1, the above-described problems were prevented by the heating device. However, as described above, the first ink was easily dried, which was inferred to be likely to cause nozzle clogging.

As in Example 2, the entire carriage including the first head and the second head was lifted up and down to increase the distance to be 4.0 mm or more between the first head and the platen. As a result, it was possible to ensure discharging reliability while minimizing bleeding.

On the other hand, as the distance between the second head to discharge the second ink and the platen increases, the landing position of the ink tends to be shifted.

In Example 1, while increasing the distance between the first head that carried the first ink that was easy to dry and the platen, the distance between the second head and the platen, for which landing accuracy was required was decreased, so that bleeding was reduced.

In Examples 3 and 4, discharging reliability is further improved as compared with Examples 1 and 2. From this, the distance between the first head and the platen is more preferably 4.5 mm or more. In particular, when the distance is 5.0 mm or more, the contact between the recording medium and the head due to the undulation of the recording medium can be further reduced.

Examples 5 and 6

Examples 5 and 6 were evaluated using the liquid discharging device of the fifth embodiment (FIG. 13) while varying the thickness of the recording medium. In Examples 5 and 6, the discharging reliability, the plastic film bleeding, and the fabric bleeding were evaluated in the same manner as in the above-described Examples and Comparative Examples. The thickness of the recording medium was changed in the fabric bleeding evaluation.

The obtained results are shown in Table 2.

TABLE 2

| | Distance between second head and platen | Distance between second head and platen | Thickness of recoding media | DIscharging reliability | Plastic film bleeding | fabric Bleeding |
|---|---|---|---|---|---|---|
| Example 5 | 5.0 mm | 4.5 mm | 4.0 mm | B | A | A |
| Example 6 | 5.0 mm | 4.5 mm | 3.5 mm | A | A | A |

Even when the distance between the first head and the platen is sufficient, if the recording medium is thick, the distance between the first head and the recording medium is reduced. At this point, since the recording medium is heated, it is considered that heat is also supplied from the recording medium toward the first head. Accordingly, the thickness of the recording medium is preferably 3.5 mm or less. It can also be said that the distance between the first head and the surface of the recording medium be preferably 1.5 mm or more.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharging device comprising:

a first head comprising a first nozzle formed on a first surface of the first head, the first head being configured to discharge a first ink comprising a metal oxide from the first nozzle;

a second head comprising a second nozzle formed on a second surface of the second head, the second head being configured to discharge a second ink comprising a coloring material from the second nozzle;

a recording medium holding unit configured to hold a recording medium;

a carriage of the recording medium holding unit configured to move the recording medium holding unit; and a heating device configured to heat the recording medium, wherein the first head discharges the first ink in a state where a first distance between the first surface and the recording medium holding unit is 4.0 mm or more.

2. The liquid discharging device according to claim 1, wherein the heating device is provided to the recording medium holding unit.

3. The liquid discharging device according to claim 2, wherein the recording medium holding unit includes a first recording medium holding region to which the heating device is provided and a second recording medium holding region to which the heating device is not provided, wherein the first head does not discharge the first ink at a position facing the first recording medium holding region.

4. The liquid discharging device according to claim 3, wherein the first recording medium holding region has a temperature gradient and a temperature of the first recording medium holding region is low on a side of the second recording medium holding region and a temperature of the first recording medium holding region is high on an opposite side of the second recording medium holding region.

5. The liquid discharging device according to claim 3, wherein the second recording medium holding region includes a region facing the first head and a region not facing the first head, wherein a temperature of the region facing the first head is lower than a temperature of the region not facing the first head.

6. The liquid discharging device according to claim 3, wherein the first recording medium holding region is upstream of the second recording medium holding region and the first head in a conveyance direction of the recording medium.

7. The liquid discharging device according to claim 1, wherein the first head is disposed upstream of the second head in a conveyance direction of the recording medium.

8. The liquid discharging device according to claim 1, further comprising a pressing member configured to press the recording medium against a part of the recording medium holding unit before the first head discharges the first ink.

9. The liquid discharging device according to claim 1, wherein the second head discharges the second ink in a state where a second distance between the second surface and the recording medium holding unit is shorter than the first distance.

10. The liquid discharging device according to claim 1, wherein the first head discharges the first ink in a state where the first distance is 4.5 mm or more.

11. The liquid discharging device according to claim 1, wherein the recording medium has a thickness of 3.5 mm or less.

* * * * *